US008103191B2

(12) United States Patent
Nukada et al.

(10) Patent No.: US 8,103,191 B2
(45) Date of Patent: Jan. 24, 2012

(54) IMAGE FORMING APPARATUS

(75) Inventors: Hidemi Nukada, Kanagawa (JP); Takahiro Suzuki, Kanagawa (JP); Isamu Ishiko, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 979 days.

(21) Appl. No.: 12/052,331

(22) Filed: Mar. 20, 2008

(65) Prior Publication Data

US 2009/0010664 A1 Jan. 8, 2009

(30) Foreign Application Priority Data

Jul. 2, 2007 (JP) ..... 2007-174342

(51) Int. Cl.
*G03G 15/00* (2006.01)

(52) U.S. Cl. ..... 399/159; 430/60; 430/131

(58) Field of Classification Search ..... 399/49, 399/72, 159; 430/60, 131
See application file for complete search history.

(56) References Cited

U.S. PATENT DOCUMENTS

| | | | | |
|---|---|---|---|---|
| 4,618,552 | A * | 10/1986 | Tanaka et al. | 430/60 |
| 4,766,048 | A * | 8/1988 | Hisamura | 430/58.05 |
| 4,786,574 | A * | 11/1988 | Shirai et al. | 430/66 |
| 4,826,748 | A * | 5/1989 | Kawamura et al. | 430/60 |
| 4,904,557 | A * | 2/1990 | Kubo | 430/56 |
| 5,215,853 | A * | 6/1993 | Andrews et al. | 430/131 |
| 5,296,323 | A * | 3/1994 | Kobata et al. | 430/58.75 |
| 5,477,312 | A | 12/1995 | Hori | |
| 5,514,507 | A * | 5/1996 | Yagi et al. | 430/57.5 |
| 5,707,767 | A * | 1/1998 | Yu | 430/58.1 |
| 5,815,776 | A * | 9/1998 | Nukada | 399/174 |
| 6,051,148 | A * | 4/2000 | Perry et al. | 216/24 |
| 7,333,752 | B2 * | 2/2008 | Kawahara et al. | 399/159 |
| 7,498,110 | B2 * | 3/2009 | Taniguchi et al. | 430/67 |
| 7,622,232 | B2 * | 11/2009 | Yokota et al. | 430/58.85 |
| 7,718,335 | B2 * | 5/2010 | Fujiwara et al. | 430/58.7 |
| 7,848,678 | B2 * | 12/2010 | Shibata et al. | 399/128 |
| 2001/0055721 | A1 * | 12/2001 | Tsuchida et al. | 430/57.7 |
| 2002/0028400 | A1 * | 3/2002 | Shimada et al. | 430/58.05 |
| 2003/0096180 | A1 | 5/2003 | Kizaki et al. | |

(Continued)

FOREIGN PATENT DOCUMENTS

JP A-7-36230 2/1995

(Continued)

OTHER PUBLICATIONS

Japanese Patent Office, *Notice of Reasons for Rejection for Japanese Patent Application No. 2007-174342* (with English translation), Mar. 29, 2011, pp. 1-2 (pp. 1-3 for translation).

*Primary Examiner* — David Gray
*Assistant Examiner* — Geoffrey Evans
(74) *Attorney, Agent, or Firm* — Oliff & Berridge, PLC

(57) ABSTRACT

The invention provides an image forming apparatus having: an image holding member; a charging unit; a latent image-forming unit; a development unit; a measuring unit; and a control unit. The image holding member has a substrate having a surface having regular reflectance in a range of about 30% to about 95% with respect to light having a first wavelength and a subbing layer having a light transmittance of about 50% or greater per unit thickness of the layer with respect to light having the first wavelength and a photosensitive layer having absorption with respect to light having a second wavelength that is different from the first wavelength.

17 Claims, 3 Drawing Sheets

U.S. PATENT DOCUMENTS

| | | | | |
|---|---|---|---|---|
| 2005/0100806 | A1* | 5/2005 | Hongo et al. | 430/78 |
| 2005/0118520 | A1* | 6/2005 | Takeshima | 430/60 |
| 2006/0013615 | A1* | 1/2006 | Nukada et al. | 399/159 |
| 2006/0013616 | A1* | 1/2006 | Nukada et al. | 399/167 |
| 2006/0014091 | A1* | 1/2006 | Nukada et al. | 430/60 |
| 2006/0014092 | A1* | 1/2006 | Nukada et al. | 430/60 |
| 2007/0077507 | A1* | 4/2007 | Otsubo et al. | 430/60 |
| 2007/0141490 | A1* | 6/2007 | Wu et al. | 430/59.1 |
| 2009/0214967 | A1* | 8/2009 | Iwanaga et al. | 430/56 |
| 2009/0253061 | A1* | 10/2009 | Yagi et al. | 430/58.65 |

FOREIGN PATENT DOCUMENTS

| | | |
|---|---|---|
| JP | A 8-44122 | 2/1996 |
| JP | A-2000-105480 | 4/2000 |
| JP | A-2000-347433 | 12/2000 |
| JP | A 2003-21919 | 1/2003 |
| JP | A-2003-29442 | 1/2003 |
| JP | A 2003-322985 | 11/2003 |
| JP | A-2005-43763 | 2/2005 |
| JP | A-2006-195041 | 7/2006 |

* cited by examiner

IMAGE FORMING APPARATUS

CROSS-REFERENCE TO RELATED APPLICATIONS

This application is based on and claims priority under 35 USC 119 from Japanese patent Application No. 2007-174342 filed on Jul. 2, 2007.

BACKGROUND OF THE INVENTION

1. Field of the Invention

The invention is related to image forming apparatus.

2. Description of the Related Art

Conventionally, image forming apparatus such as copying machines or printers forming color images or monochromatic images are known as image forming apparatus utilizing an electrophotographic system.

SUMMARY OF THE INVENTION

Enhancing the accuracy of density detection by correcting the density in a region where no toner image is formed to a half tone density or a density similar to the recording medium for ultimate transfer is known. In such technologies, there have been concerns that the accuracy of detection by the density sensor may deteriorate due to wear on the surface of the electrophotographic photoreceptor or the transfer roll where toner images are formed as a measuring object, due to chances over time or environmental fluctuations.

A first embodiment of one aspect of the invention is an image forming apparatus comprising:

an image holding member comprising:

a substrate having a surface having a regular reflectance to light having a first wavelength is in a range of about 30% to about 95% with respect to light having a first wavelength; and a subbing layer having a light transmittance of about 50% or greater per unit thickness of the layer with respect to the light having the first wavelength of about 50% or greater; and a photosensitive layer having absorption with respect to the light having a second wavelength that is different from the first wavelength, which are provided the subbing layer and the photosensitive layer being layered on the substrate in this order;

a charging unit which charges the image holding member;

a latent image-forming unit which forms an electrostatic latent image on the image holding member by exposing the image holding member charged by the charging unit with the light with having the second wavelength in the second wavelength region;

a development unit which develops the electrostatic latent image using a toner and forms a toner image corresponding to the electrostatic latent image on the image holding member;

a measuring unit which comprises:

an irradiationg unit which irradiates light having the first wavelength onto the image holding member; and a detectiong unit which detects a reflected light generated by the irradiation of light from the irradiationg unit, and measures the density of the toner image formed on the image holding member based on the reflected light detected by the detectiong unit; and a control unit which controls the latent image-forming unit so that the latent image-forming unit forms the electrostatic latent image corresponding to a pictorial image having a predetermined density and, based on a measurement result of the density of the toner image obtained by the measuring unit, controls at least one selected from: a charged potential of at which the image holding member is charged by the charging unit; an exposure amount of at which the image holding member provided is exposed by the latent image-forming unit; and a development potential of at which the toner is developed by the development unit, so that the measurement result obtained by the measurement unit becomes substantially equal to the predetermined density.

DETAILED DESCRIPTION

Figure 1:
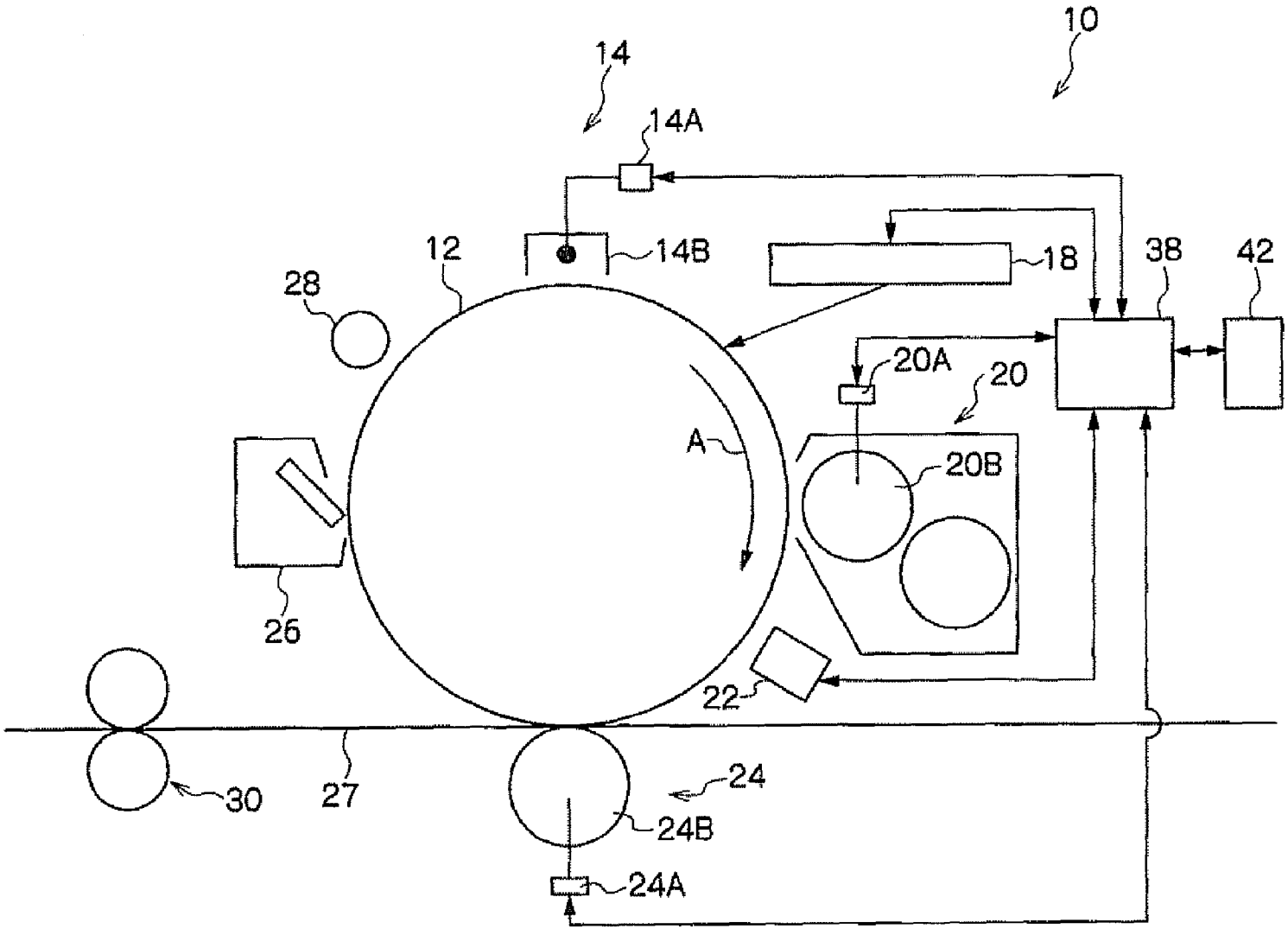
FIG. 1 is a schematic configuration diagram showing one aspect of the image forming apparatus of the present embodiment.

The image forming apparatus 10, which is one exemplary embodiment of the image forming apparatus of the invention, is provided with a photoreceptor 12 as shown in FIG. 1. The photoreceptor 12 is provided rotatably in a predetermined direction (the direction of arrow A in FIG. 1). Around the photoreceptor 12, a charging device 14, an exposing device 18, a developing device 20, a density measuring device 22, a transfer device 24, a cleaning device 26 and an erasing device 28 are disposed successively along the direction of rotation (the direction of arrow A in FIG. 1) of the photoreceptor 12.

The charging device 14 corresponds the charging unit of the image forming apparatus of the present invention, and the photoreceptor 12 corresponds to an image holding member of the image forming apparatus of the present invention. The exposing device 18 of one exemplary embodiment corresponds to the latent image-forming unit of the image forming apparatus of the present invention, the developing device 20 corresponds to the development unit of the image forming apparatus of the present invention, and the density measuring device 22 corresponds to the measurement unit of the image forming apparatus of the present invention.

Figure 3:
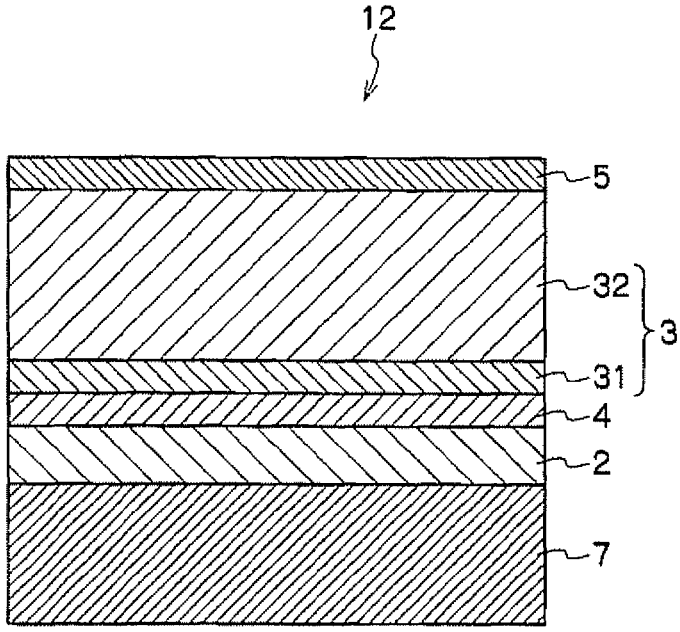
FIG. 3 is a schematic cross-sectional view showing an example of a photoreceptor in the image forming apparatus of the present embodiment.

The photoreceptor 12, a detailed configuration of which is described below, has a configuration in which at least a subbing layer 2 and a photosensitive layer 3 on an electrically conductive substrate 7 are provided as shown in FIG. 3. The regular reflectance of the surface of the electrically conductive substrate 7 to a light with a predetermined first wavelength is arranged in a range of about 30% to about 95% on the photoreceptor 12.

The subbing layer 2 is adjusted to have a light transmittance of about 50% or greater per unit thickness of the layer to the light having the first wavelength. Furthermore, the photosensitive layer 3 does not have absorption with respect to light having the first wavelength, and it has absorption with respect to light having the second wavelength different from the first wavelength.

The expression "have absorption" herein means that the absorbance when light of a specific wavelength (the first wavelength or the second wavelength in the present embodiment) is irradiated is about 1/10 or more of the absorbance at the maximum absorbing wavelength.

Similarly, the expression "does not have absorption" herein means that the absorbance when light of a specific wavelength (the first wavelength or the second wavelength in the present embodiment) is irradiated is less than about 1/10 of the absorbance at the maximum absorbing wavelength.

The absorbance is defined in this exemplary embodiment of the invention as the value measured by a spectrophotometer when an object is irradiated with light having a wavelength to be measured.

The charging device 14 will charge the surface of the photoreceptor 12 to a predetermined charging potential. The charging device 14 has a configuration of containing a charger 14B and a power source 14A. The charger 14B is electrically connected with the power source 14A and will charge the surface of the photoreceptor 12 up to the charging potential corresponding to the power supplied from the power source 14A.

Any publicly known charger can be employed as the charger 14B. When the charger is a contact type, a roll, a brush, a magnetic brush, a blade and the like is employable and when it is a non-contact type, a corotron, a scorotron or the like is employable.

The contact type charging performs charging the surface of the photoreceptor by applying an electric voltage to an electrically conductive member contacting with the surface of the photoreceptor. Any shape can be employed for the electrically conductive member, and examples thereof include a brush-shaped one, a blade-shaped one, a pin electrode-shaped one, a roll-shaped one or the like. Particularly preferable examples thereof include the roll-shaped electrically conductive member. Usually, the roll-shaped component is composed of a core material, an elastic layer formed on the core material, and a resistor formed on the elastic layer. Further, a protective layer may be provided outside of the resistor layer, if necessary.

The process for charging the photoreceptor 12 by means of the electrically conductive member include applying an electric voltage to the electrically conductive member. The applied voltage is preferably a DC voltage or a DC voltage superimposed with an AC voltage. The range of the voltage to be applied is preferably in the range of from about 50 V to about 2,000 V, and is particularly from about 100 V to 1,500 V in positive or in negative, depending on a required charging potential of the photoreceptor, in a case where the applied voltage is a DC voltage. In the case where an AC voltage is superimposed, a peak to peak voltage is within the range of from about 400 V to about 1,800 V, preferably from about 800 V to about 1,600 V, and further preferably from about 1,200 V to about 1,600 V. The frequency of the AC voltage is typically from about 50 Hz to about 20,000 Hz and preferably from about 100 Hz to about 5,000 Hz.

The exposing device 18 forms an electrostatic latent image corresponding to an image data of an image, which is to be formed by the image forming apparatus 10, on the photoreceptor 12 by exposing the photoreceptor 12, which is charged by the charging device 14, with light having an wavelength which can be absorbed by the photosensitive layer of the photoreceptor 12.

In the exemplary embodiment of the invention, since the photosensitive layer 3 of the photoreceptor 12 has absorption with respect to light having the second wavelength as explained in the description, the exposing device 18 can form an electrostatic latent image by exposing the photoreceptor 12 with the light having the second wavelength.

Any publicly known exposing device may be employed as the exposing device 18 as long as it is capable of exposing the photoreceptor 12 with the light having the second wavelength. Optical system equipments capable of conducting desired imagewise exposure with a light source can be used as the exposing device 18, and examples thereof include a semiconductor laser, a LED (light emitting diode), a liquid crystal shutter and the like. Specifically, when the exposing device 18 is capable of exposing incoherent light is used, a generation of an interference fringe between the electrically conductive substrate 7 and the photosensitive layer 3 on the photoreceptor 12 can be prevented.

Any light source capable of irradiating the light having the first wavelength about which the photoreceptor 12 has absorption may be used as the light source for exposing the surface of the photoreceptor 12 by the exposing device 18. The light source can be selected depending on the structure of the photosensitive layer 3 on the photoreceptor 12. Examples of the light source include a semiconductor laser and a flat panel light emission type laser source capable of multi-beam outputting.

The developing device 20 can develop an electrostatic latent image using toner, details of which will be described below, to form a toner image corresponding to the electrostatic latent image on the photoreceptor 12.

This developing device 20 has a configuration having a developing roll 20B for carrying a stored toner and supplying the carried toner onto the surface of the photoreceptor 12; and of a developing bias voltage applying component 20A for applying a developing bias voltage to the developing roll 20B.

With regard to the developing device 20, any publicly known developing device 20 is employable. Regarding with the developing process, a two-composition developing process consisting of carrier and toner, one-composition developing process consisting of toner only, and all other developing processes which may have cases that another constituents are added in order for improving developing or other characteristics are usable.

The density measuring device 22 detects the density of the toner image formed onto the photoreceptor 12.

The "density of the toner image", exhibits a developing amount of toner per unit area (amount of toner per unit area carried by the photoreceptor 12). Namely, the more the amount of toner per unit area increases, the higher is the density of toner image detected.

The density measuring device 22 is disposed, as shown in FIG. 1, at a downstream side in the direction of rotation (the direction of arrow A in FIG. 1) of the photoreceptor 12 from the position at which the developing device 20 is provided, and at an upstream side in the direction of rotation of the photoreceptor 12 from the position at which the transfer device 24 is provided, and is disposed at a position from which the density of the toner image carried on the photoreceptor 12 is detectable.

Figure 2:
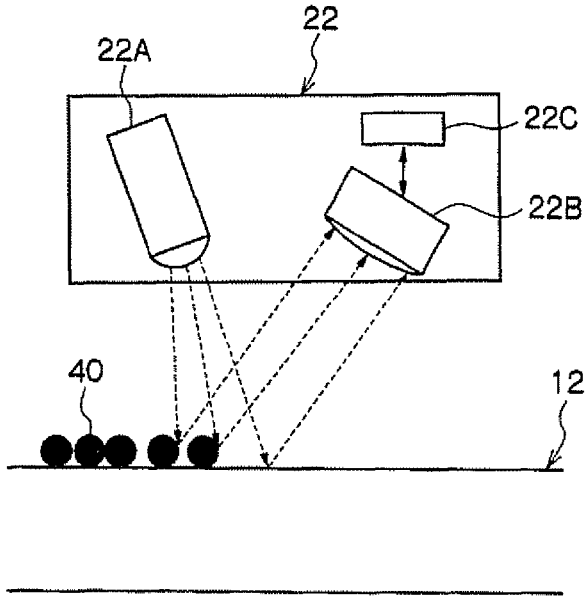
FIG. 2 is a schematic view showing one aspect of a density measuring device provided at the image forming apparatus of the present embodiment.

The density measuring device 22 is composed of, as shown in FIG. 2, a light emitting element 22A for irradiating light onto the photoreceptor 12, a photo sensor element 22B for detecting intensity of reflected light of the light irradiated by the light emitting element 22A and an arithmetically calculating component 22C.

Additionally, the density measuring device 22 corresponds to a measurement unit of the image forming apparatus of the present invention, the light emitting element 22A corresponds to an irradiation unit and the photo sensor element 22B corresponds to a detecting unit.

It is appropriate for the light emitting element 22A that it has a configuration capable of irradiating the light having the first wavelength about which the photosensitive layer 3 of the photoreceptor 12 has not absorption, and about which the subbing layer 2 exhibits optical transmittance of 50% or more, onto the photoreceptor 12, and publicly kmown light sources, optical lens assemblies for increasing directivity toward the light source or so is employable.

With regard to the photo sensor element 22B, it is appropriate to have a configuration capable of generating a sufficient photoelectric current having absorption to the light irradiated from the light emitting element 22A (the light having the first wavelength in one exemplary embodiment of the invention), and publicly known photo sensor element, for example, a photo diode, photo transistor or so is employable.

The arithmetically calculating component 22C is connected to the photo sensor element 22B in a manner capable of transmitting and receiving signal, and arithmetically calculates the toner density based on the intensity of reflected light detected by the photo sensor element 22B.

The intensity of reflected light generated by light irradiated from light emitting element 22A by toner 40 carried on the photoreceptor 12 and the intensity of reflected light by toner 40 in the region not carried on the photoreceptor 12 exhibit different values from each other. Further, when the amounts of toner per unit area carried on the photoreceptor 12 are different, the intensity of reflected light generated by light irradiated from the light emitting element 22A exhibits different values depending on the amount of toner carried per unit area.

Accordingly, in the arithmetically calculating component 22C, a measurement result of the intensity of reflected light by the photo sensor element 22B about the region where toner 40 is not carried on the photoreceptor 12 is stored in advance as standard reflection intensity, the density of a toner image is arithmetically calculated based on the difference between the standard reflection intensity and the intensity of reflected light detected by the photo sensor element 22B when the toner image is formed on the photoreceptor 12.

The arithmetic calculation for obtaining the density of the toner image can be carried out, for example, by storing, in advance, the density information exhibiting the toner density corresponding to the differential information indicating the difference between the standard reflection intensity stored beforehand and the intensity per unit area of the intensity of reflected light detected by the photo sensor element 22B, and by reading the density information corresponding to the differential information of difference between the intensity per unit area of the intensity of reflected light detected by the photo sensor element 22B and the standard reflection intensity, and finally calculating the toner density. The method for arithmetically calculating the toner density is not limited to this, and examples thereof further include one which performs storing, in advance, a calculation formula for arithmetically calculating the toner density based on the standard reflection intensity and the differential information with standard reflection intensity; and calculating the toner density according the calculation formula.

As described above, the density measuring device 22 is configured to be capable of measuring the density of the toner image carried on the photoreceptor 12 based on the intensity of the reflected light generated by irradiating the light having the first wavelength, which is the wavelength to which the photosensitive layer 3 of the photoreceptor 12 does not have absorption and the subbing layer exhibits optical transmittance of about 50% or more per unit thickness of the layer, to the photoreceptor 12.

The transfer device 24 transfers the toner image on the photoreceptor 12 onto a recording medium 27.

The transfer device 24 is configured by having: a transferring roll 24B which pinches and conveys the recording medium 27 between the photoreceptor 12 and the roll itself, together with forming an electric field for transmitting (transferring) the toner image on the photoreceptor 12 onto the recording medium 27 side; and a transferring bias voltage applying component 24A for applying the transferring bias voltage to the transferring roll 24B.

Any publicly known transfer device may be employed as the transfer device 24. When the transfer device is a contact type transfer device, a roll-shaped one, a brush-shaped one, a blade-shaped one or the like can be used, and when it is a non-contact type transfer device, a corotron, a scorotron, a pincorotron or or the like can be used. The transferring may also be performed with pressure or with a combination of pressure and heat.

The recording medium 27 stocked on a recording medium feeding component, not shown, is conveyed by means of a conveyer rolls, not shown, or so thereby conveyed to a region where the photoreceptor 12 and the transfer device 24 face each other, and the recording medium 27 is conveyed while being pinched between the photoreceptor 12 and the transfer device 24 resultantly transferring the toner image on the photoreceptor 12 to the recording medium 27.

Additionally in one exemplary embodiment of the invention, although the explanation is that the recording medium 27 is conveyed while being pinched between the photoreceptor 12 and the transfer device 24 resultantly transferring the toner image on the photoreceptor 12 to the recording medium 27, the image forming apparatus 10 is not limited to such an embodiment, and after transferring the toner image formed on the photoreceptor 12 onto an intermediate transferring member (not shown) such as an intermediate transferring belt, transferring the toner image transferred onto the intermediate member further onto the recording medium 27 is also probable.

With regard to the intermediate transferring member, conventional publicly known electrically conductive thermoplastic resins are employable. Examples of the electrically conductive thermoplastic resin include polyimide resins containing a conducting agent, polycarbonate resins (PC), polyvinylidene fluoride (PVDF), polyalkylene terephthalates (PAT), blend materials such as ethylenetetrafluoroethylene copolymer (ETFE)/PC, ETFE/PAT, PC/PAT, or so. Among those, in a viewpoint of superiority in mechanical strength, it is preferable to employ the polyimide resin into which the conducting agent is dispersed. With regard to the conducting agent, electrically conductive polymers such as carbon blacks, metal oxides, polyanilines or so are employable. Further, the intermediate transferring member may have a surface layer.

The cleaning device 26 removes foreign matters such as toner or paper powder remaining on the photoreceptor 12 after transferring the toner image onto the recording medium 27. It is preferable that the cleaning device 26 has a magnetic brush, electrically conductive fiber brush, blade or so as a cleaning member The erasing device 28 erases remained charge of the photoreceptor 12.

The photoreceptor 12, whose toner image carried by itself was transferred by the transfer device 24 onto the recording medium 27, and further, whose foreign matters on its surface side were removed by means of the cleaning device 26, is charged again by means of the charging device 14 soon after the remained charge was erased by means of the erasing device 28 owing to its rotation in a direction (arrow A direction in FIG. 1) of rotation, Further, the image forming apparatus 10 has a fixing device 30 which fixes the toner image transferred on the recording medium 27. Any publicly known fixing unit may be employable as the fixing device 30.

When the recording medium 27, on which the toner image was transferred by the transfer device 24, is conveyed to the fixing device 30 by means of conveyer rolls, not shown, or so to the fixing device 30, the toner image on the recording medium 27 will be fixed by means of the fixing device 30 and will become a state that a pictorial image is formed on the recording medium 27. The recording medium 27 on which the pictorial image is formed will be conveyed by means of the conveyer rolls, not shown, to outside of the image forming apparatus 10.

A detailed explanation about the photoreceptor 12 arranged to the image forming apparatus 10 will be described in the following.

As described above, the photoreceptor 12 is composed by laminating the subbing layer 2 whose optical transmittance is about 50% or greater per unit thickness of the layer with respect to the light having the first wavelength irradiated from the light emitting element 22A, and the photosensitive layer 3 not having absorption with respect to light having the first wavelength but having absorption with respect to light having the second wavelength irradiated from the exposing device 18, different from the first wavelength, on the electrically conductive substrate 7 whose regular reflectance of the surface of itself to the light irradiated from the light emitting element 22A of the density measuring device 22 and with the first wavelength is arranged in a range of about 30% to about 95%.

The regular reflectance of the surface of the electrically conductive substrate 7 with respect to the light irradiated from the light emitting element 22A of the density measuring device 22 and with the first wavelength is, as described above, arranged in a range of about 30% to about 95%, further preferably within a range of about 35% to about 90%, and particularly preferably in a range of about 40% to about 85%.

When the regular reflectance of the surface of the electrically conductive substrate 7 with respect to the light irradiated from the light emitting element 22A of the density measuring device 22 and with the first wavelength is smaller than about 30%, any reflected light having intensity with an extent that can be detected as the density by the photo sensor element 22B of the density measuring device 22 will not enter and accordingly, there is an occasion that the accuracy of measurement about the toner density degrades will occur.

Further, when the regular reflectance of the surface of the electrically conductive substrate 7 with respect to the light irradiated from the light emitting element 22A of the density measuring device 22 and with the first wavelength exceeds about 95%, a reflected light having intensity with an extent that can be detected as the density by the photo sensor element 22B of the density measuring device 22 will enter and accordingly, there is an occasion that the accuracy of measurement about the toner density degrades will also occur.

Additionally in one exemplary embodiment of the invention, the regular reflectance of the surface of the electrically conductive substrate 7 with respect to the light irradiated from the light emitting element 22A of the density measuring device 22 and with the first wavelength is determined as follows. Namely, irradiating the light having the first wavelength and being the target of the measurement to the electrically conductive substrate 7 by means of COLOR ANALYZER TYPE 607 (trade name, manufactured by Hitachi, Ltd.), measuring both a total reflectance and a diffusion reflectance of the electrically conductive substrate 7 with respect to light having the first wavelength, and calculating a difference therebetween by subtracting the diffusion reflectance from the total reflectance, which difference was determined as the regular reflectance (%).

The light transmittance of the subbing layer 2 per unit thickness of the layer with respect to light having the first wavelength irradiated from the light emitting element 22A of the density measuring device 22 is about 50% or greater, preferably in a range of about 50% to about 95%, further preferably within a range of about 60% to about 95%, and particularly preferably in a range of about 70% to about 95%.

When the subbing layer 2 has a light transmittance of smaller than about 50% per unit thickness of the layer to the light having the first wavelength irradiated from the light emitting element 22A of the density measuring device 22, any reflected light having intensity with an extent that can be detected as the density by the photo sensor element 22B of the density measuring device 22 will not enter and accordingly, there is an occasion that the accuracy of measurement about the toner density degrades will occur. When the subbing layer 2 has a light transmittance of exceeding about 95% per unit thickness of the layer to the light having the first wavelength irradiated from the light emitting element 22A, a reflected light having intensity with an extent that can be detected as the density by the photo sensor element 22B of the density measuring device 22 will enter and accordingly, there is an occasion that the accuracy of measurement about the toner density degrades will also occur thereby causing a problem.

Additionally in one exemplary embodiment of the invention, the light transmittance means a transmission factor of the light in depthwise direction (lamination direction) and it can be measured by means of a spectrophotometer U-4000 (trade name, manufactured by Hitachi High-Technologies Corporation).

Further, it is preferable that the conditions of the subbing layer 2 satisfy the relationship expressed by the following Inequality (1):

$$Y > X/4.5 \qquad \text{Inequality (1)}$$

In Inequality (1), X represents the light transmittance (%) per unit thickness of the subbing layer 2 with respect to the light of the wavelength in the first wavelength region, and Y represents the thickness (μm) of the subbing layer 2.

When the subbing layer 2 satisfies the relation of Inequality (1), it becomes possible to adjust the reflectance of the whole photoreceptor 12 to the light having the first wavelength so as to be the reflectance to the extent that the density detection about the photo sensor element 22B of the density measuring device 22 does not cause degradation of accuracy of measurement of the toner density and accordingly, adjusting the thickness of the subbing layer 2 enables to easily adjust the reflectance of the whole photoreceptor 12 to the light having the first wavelength.

The photosensitive layer 3 does not have absorption with respect to light having the first wavelength irradiated from the light emitting element 22A of the density measuring device 22, but it has absorption with respect to light having the second wavelength irradiated from the exposing device 18 and being different from the first wavelength.

The regular reflectance of the photoreceptor 12 as a whole with respect to light irradiated from the light emitting element 22A of the density measuring device 22 and having the first wavelength is preferably in a range of about 30% or less, further preferably in a range of about 25% or less, and particularly preferably in a range of about 20% or less.

The regular reflectance to the light having the first wavelength in the photoreceptor 12 can be measured in the same manner as that in the electrically conductive substrate 7, and setting the regular reflectance within the range will achieve the effect of enabling to measure the toner density with high accuracy.

As described above, the photoreceptor 12 in one exemplary embodiment of the invention is composed by laminating the subbing layer 2 whose optical transmittance is about 50% or greater per unit thickness of the layer with respect to the light having the first wavelength irradiated from the light emitting element 22A, and the photosensitive layer 3 not having absorption with respect to light having the first wavelength but having absorption with respect to light having the second wavelength irradiated from the exposing device 18, different from the first wavelength, on the electrically conductive substrate 7 whose regular reflectance of the surface of itself to the light irradiated from the light emitting element 22A of the density measuring device 22 and with the first wavelength is arranged in a range of about 30% to about 95%.

Accordingly, when the density of the toner image carried by the photoreceptor 12 is measured by the density measuring device 22, the light having the first wavelength irradiated from the light emitting element 22A of the density measuring device 22 will pass through the photoreceptor 12 not having absorption with respect to light having the first wavelength, and through the subbing layer 2 exhibiting the light transmittance of 50% or greater resultantly arriving to the electrically conductive substrate 7. Because the regular reflectance of the surface side of the electrically conductive substrate 7 to the light having the first wavelength irradiated from the light emitting element 22A of the density measuring device 22 is within the range of from about 30% to about 95% as described above, the reflected light generated by the irradiation of light having the first wavelength arrived to the electrically conductive substrate 7 will pass through plural layers (the photosensitive layer 3, the subbing layer 2 and so on) arranged at the surface side than the electrically conductive substrate 7 thereby resultantly arriving to the photo sensor element 22B of the density measuring device 22.

Further, in the density measuring device 22, based on the result of detecting intensity of the reflected light received by means of the photo sensor element 22B, the density of the toner image on the photoreceptor 12 will be required at the arithmetically calculating component 22C.

As described above, the light emitting element 22A of the light emitting element 22A irradiates the light having the first wavelength about which the photosensitive layer 3 of the photoreceptor 12 does not have absorption, light transmittance of the subbing layer 2 is about 50% or greater, and the regular reflectance at the electrically conductive substrate 7 is within the above range toward photoreceptor 12, and the light having the first wavelength irradiated from the light emitting element 22A of the density measuring device 22 toward photoreceptor 12 passes through the photosensitive layer 3 with the above structure composing the photoreceptor 12 and the subbing layer 2 with the above structure resultantly arriving to the electrically conductive substrate 7 with the above structure and from there, it passes through each layers such as the subbing layer 2, the photosensitive layer 3 or so thereby resultantly arriving to the photo sensor element 22B of the density measuring device 22.

Therefore, the reflected light with high accuracy and stable intensity will be receivable in the photo sensor element 22B of the density measuring device 22, without receiving influence of the changes of the surface situation by abrasion or so of the photoreceptor 12, influence of absorption of the light in the photosensitive layer 3 and influence of the light transmission characteristics of the subbing layer 2.

Details of the configuration of the photoreceptor 12 is explained hereinafter.

The photoreceptor 12 may have any configuration as long as the electrically conductive substrate 7, the photosensitive layer 3, and the subbing layer 2 are provided (laminated) and satisfy the above-described characteristics. One exemplary embodiment of configuration of the the photoreceptor 12 has a laminated structure in which an undercoat layer 2, an intermediate layer 4, a photosensitive layer 3 and a protective layer 5 are provided in this order on an electrically conductive substrate 7 as shown in FIG. 3. The photoreceptor 12 shown in FIG. 3 is one with layers having different functions, and the photorsensitive layer 3 has a charge generating layer 31 and a charge transporting layer 32.

Examples of the electrically conductive substrate 7 include: drums made of a metal such as aluminum, copper, iron, stainless steel, zinc, or nickel; those in which a metal such as aluminum, copper, gold, silver, platinum, palladium, titanium, nickel-chromium, stainless steel, or indium, or an electrically conductive metal compound such as indium oxide or tin oxide is deposited on a substrate made of paper, plastic, or glass; those in which a metal foil is laminated on the above-described substrate; and those in which the above-described substrate has been subjected to electrically conductive treatment by applying a dispersion in which carbon black, indium oxide, tin oxide, antimony oxide powder, metal powder or copper iodide is dispersed in a binder resin thereto.

The shape of the electrically conductive substrate 7 is not restricted to the drum shape, and may be a sheet-like shape or a plate-like shape. When the electrically conductive substrate 7 is a metal pipe, the surface of the pipe may be bare, or may be subjected to such treatment as mirror-surface grinding, etching, anodic oxidation, rough grinding, centerless grinding, sand blasting and/or wet honing.

In order to adjust the regular reflectance of the surface of the electrically conductive substrate 7 with respect to the light irradiated from the light emitting element 22A of the density measuring device 22 and with the first wavelength in a range of about 30% to about 95%, the following treatment should be carried out.

Examples of the treatment include surface treatments such as precise cutting treatment, homing treatment, sandblast treatment, chemical treatment, or the like.

Although the subbing layer 2 may have any configuration as long as it satisfies the described condition, it is preferable to contain a filler for reasons of securing electroconductivity or semiconductivity and suppressing interference fringe.

When the light transmittance of the subbing layer 2 is about 50% or greater, the filler content is not particularly limited, while the filler content in the subbing layer 2 is preferably about 5% by volume to about 70% by volume, and further preferably about 5% by volume to about 60% by volume, relative to a total volume of the subbing layer 2.

When the filler content in the subbing layer 2 is less than about 5% by volume, there will be an occasion that a moire pattern as a picture quality error tend to occur, and when it exceeds about 70% by volume, there will be an occasion that problems of film-forming property degradation causing peel-off and crack easily. Examples of the filler include resin particles and metal oxide particles, and when the metal oxide particles are employed, regulating electric resistance from increasing despite thickening of the layer thickness, preventing degradation of electric characteristic owing to repeated use of the photoreceptor 12 together with simultaneously reducing resin ratio in the subbing layer 2 enables to obtain a configuration almost free from receiving damages against exposure of the light with short wavelength.

The powder resistance (volume resistivity) of the metal oxide particles to which the acceptor compound is to be added should be about $10^2$ to about $10^{11}$ Ωcm. This is because the subbing layer 2 should have a suitable resistance to acquire leak resistance. The metal oxide particles preferably include at least one selected from the group consisting of fine particles of titanium oxide, zinc oxide, tin oxide and zirconium oxide having a resistance in the above range in consideration of the electric characteristics and image stability upon repeating utilization for over long term. The metal oxide particles are more preferably zinc oxide fine particles.

In a case wherein the metal oxide particles have a resistance lower than the lower limit of the above range, sufficient leak resistance may not be provided, while those having a resistance higher than the upper limit of the range may cause an increase in residual electric potential. Two or more kinds of metal oxide particles, each of which are subjected to a surface treatment different from each other or have a diameter different from each other, may be used as a mixture. The metal oxide particles preferably have a specific surface area of about 10 $m^2/g$ or more. Metal oxide particles having a specific surface area of lower than about 10 $m^2/g$ may easily cause deterioration in electrostatic properties, making it difficult to obtain good electrophotographic properties.

The volume-average diameter of the metal oxide particles is preferably in the range of about 50 nm to about 200 nm.

The metal oxide particles may be subjected to surface treatment before being added to the subbing layer. Any known surface treating agent may be used, as long as it provides desired properties. Examples thereof include coupling agents such as silane coupling agents, titanate coupling agents, and aluminum coupling agents; and surface-active agents. Use of a silane coupling agent is particularly preferable, since it provides good electrophotographic properties. Preferable examples thereof include an amino group-containing silane coupling agent and an unsaturated group-containing silane coupling agent in view of providing the subbing layer 2 with a good blocking property as well as suppressing deterioration of the metal oxide particles upon being exposed to irradiation light.

The amino group-containing silane coupling agent is not particularly limited, as long as it provides the photoreceptor with desired properties. Specific examples thereof include, but are not limited to, γ-aminopropyltriethoxysilane, N-β-(aminoethyl)-γ-aminopropyltrimethoxysilane, N-β-(aminoethyl)-γ-aminopropylmethylmethoxysilane, and N,N-bis(β-hydroxyethyl)-γ-aminopropyltriethoxysilane.

Two or more silane coupling agents may be used together. Examples of the silane coupling agent that can be used in combination with the amino group-containing silane coupling agent include, but are not limited to, vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

Examples of the unsaturated group-containing silane coupling agent include, but are not limited to, vinyltrimethoxysilane, vinyltriethoxysilane, γ-methacryloxypropylmethyldimethoxysilane, γ-methacryloxypropyltriethoxysilane, and γ-methacryloxypropyltrimethoxysilane.

Any known method may be used as a method for surface treatment of the silane coupling agent, and specific examples thereof include a dry method and a wet method.

When the dry method is carried out for the surface treatment, the metal oxide particles are uniformly processed by adding a silane coupling agent in a direct manner, by dripping a solution, in which the silane coupling agent is dissolved in an organic solvent, or by spraying a solution, in which the silane coupling agent is dissolved in an organic solvent, together with dry air or nitrogen gas stream, to the metal oxide particles, which are being agitated with a high-shearing force mixer. The addition or spraying is preferably carried out at a temperature equal to or lower than the boiling point of the solvent. When spraying is carried out at a temperature of higher than the boiling point of the solvent, the solvent may evaporate before uniform agitating of the silane coupling agent is achieved, and the silane coupling agent may become localized, making it difficult to conduct uniform processing. The metal oxide particle may be further baked at a temperature of about 100° C. or more after the addition or spraying. The baking temperature and time may be arbitrarily set as long as desirable electrophotographic properties can be obtained thereby.

When the wet method is carried out for the surface treatment, the metal oxide particles are uniformly processed by dispersing the metal oxide particles in a solvent with an agitator, an ultrasonicator, a sand mill, an attritor, or a ball mill, adding solution containing the silane coupling agent to the particles, agitating the resulting mixture, and removing a solvent in the resulting mixture. The solvent is usually removed by filtration or distillation. The metal oxide particles may be further baked at a temperature of about 100° C. or more. The baking temperature and time may be arbitrarily set as long as desirable electrophotographic properties can be obtained. In the wet methods, moisture contained in the metal oxide particles may be removed before the addition of a surface treating agent by, for example, heating and agitating the particles in a solvent used in the surface treatment or by azeotropic distillation of water and the solvent.

The amount of the silane coupling agent with respect to that of the metal oxide particles in the subbing layer 2 may be arbitrarily set, as long as it enables to provide desired electrophotographic properties.

The subbing layer 2 preferably contains the metal oxide particles and an acceptor compound having a group capable of reacting with the metal oxide particles.

The inclusion of the acceptor compound in the subbing layer 2 in combination with the metal oxide particles may make the exchanging of charge between the electrically conductive substrate 7 and the charge generating layer 31 in the subbing layer 2 efficient and enable a long term application for high quality image formation and high-speed response.

While any compound may be used as the acceptor compound, as long as it has desired properties, the acceptor compound preferably has a hydroxyl group. Furthermore, the acceptor compound more preferably has an anthraquinone structure having a hydroxyl group. Examples of the acceptor compound having the anthraquinone structure having a hydroxyl group include a hydroxyanthraquinone compound and an aminohydroxyanthraquinone compound. Specific examples thereof include alizarin, quinizarin, anthrarufin, purpurin, 1-hydroxyanthraquinone, 2-amino-3-hydroxyanthraquinone, 1-amino-4-hydroxyanthraquinone and the like.

The addition amount of the acceptor compound can be arbitrarily set as long as desired properties can be obtained. It is preferably about 0.01 weight % to about 20 weight % with respect to the amount of the metal oxide particles, and more preferably about 0.05 weight % to about 10 weight % with respect to the amount of the metal oxide particles.

In a case where the subbing layer 2 contains the acceptor compound in an amount of less than 0.01 weight %, a sufficient accepting capacity to improve prevention of charge accumulation therein may not be provided to the metal oxide particles, which may easily lead to deterioration in maintenance property of the subbing layer due to an increase in residual electric potential during repeated use or the like.

On the other hand, in a case where the subbing layer 2 contains the acceptor compound in an amount of more than 20 weight %, the metal oxide particles may tend to undesirably aggregate, and consequently the metal oxide may not form desired electrically conductive paths in the subbing layer 2 during formation of the subbing layer 2, which may easily lead to deterioration in maintenance property of the subbing layer due to an increase in residual electric potential during repeated use, as well as may cause image quality defects of black spots.

The acceptor compound can be uniformly added to the metal oxide particles, for example, by dripping a solution in which the acceptor compound is dissolved in an organic solvent or by spraying the solution together with dry air or a nitrogen gas on the metal oxide particles, which are being agitated with a high-shearing force mixer. The addition or spraying of the acceptor compound solution is preferably carried out at a temperature equal to or lower than the boiling point of the solvent. When the spraying is carried out at a temperature of higher than the boiling point of the solvent, the solvent evaporates before uniform agitating of the solution and the acceptor compound particles locally aggregate and thereby uniform processing cannot be conducted. After the addition or spraying, the metal oxide particles may be dried at a temperature equal to or higher than the boiling point of the solvent. Alternatively, the acceptor compound is added to the metal oxide particles by uniformly adding the acceptor compound solution to the metal oxide particles dispersed in a solvent with an agitator, an ultrasonicator, a sand mill, an attritor or a ball mill, agitating the resultant mixture under reflux or at a temperature equal to or lower than the boiling point of the organic solvent, and removing the solvent. The solvent is usually removed by filtration, distillation, or heat drying.

The binder resin for use in the subbing layer 2 is not particularly limited, as long as it forms a good film and provides the film with desired properties. The binder resin can be a known polymer resin compound. Examples thereof include acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, or urethane resins. The binder resin can also be a charge transport resin having a charge transport group or an electrically conductive resin such as polyaniline. Among them, a resin insoluble in coating solutions for layers on or above the subbing layer is preferable as the binder resin. Specific examples thereof include phenol resins, phenol-formaldehyde resins, melamine resins, urethane resins, and epoxy resins.

The ratio of the metal oxide particles to the binder resin in the coating solution for forming the subbing layer 2 may be arbitrarily set, as long as the photoreceptor 12 with desired properties can be obtained. In view of reducing damage of the subbing layer 2 caused by being irrdiated with light, the volume ratio of the metal oxide particles to the binder resin in the coating solution (the metal oxide particles/the binder resin) is preferably in a range of about 10/90 to about 90/10, and is more preferably in a range of about 15/85 to about 60/40.

Various additives may be added to the coating solution for forming the subbing layer in order to improve electrical properties, environmental stability, and/or image quality of the subbing layer.

Examples of such additives include electron transport materials including quinone compounds such as chloranil or bromoanil, tetracyanoquinodimethane compounds, fluorenone compounds such as 2,4,7-trinitrofluorenone or 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole, or 2,5-bis(4-diethylaminophenyl)1,3,4oxadiazole, xanthone compounds, thiophene compounds, and diphenoquinone compounds such as 3,3',5,5'-tetra-t-butyldiphenoquinone; electron transport pigments such as polycyclic condensates or azo pigments; zirconium chelate compounds, titanium chelate compounds, aluminum chelate compounds, titanium alkoxide compounds, organic titanium compounds, and silane coupling agents.

The silane coupling agent can be used in surface treatment of a filler, but may be also used as a additive to the coating solution. Specific examples of the silane coupling agent include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Examples of the zirconium chelate compound include zirconium butoxide, ethyl zirconium acetoacetate, zirconium triethanolamine, acetylacetonatozirconium butoxide, ethyl zirconium butoxide acetoacetate, zirconium acetate, zirconium oxalate, zirconium lactate, zirconium phosphonate, zirconium octanate, zirconium naphthenate, zirconium laurate, zirconium stearate, zirconium isostearate, methacrylatozirconium butoxide, stearatozirconium butoxide and isostearatozirconium butoxide.

Examples of the titanium chelate compound include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethylester, titanium triethanol aminate, and polyhydroxytitanium stearate.

Examples of the aluminum chelate compound include aluminum isopropylate, monobutoxyaluminum diisopropylate, aluminum butylate, diethylacetoacetatoaluminum diisopropylate, and aluminum tris(ethylacetoacetate).

These compounds may be used singly or in combination of two or more of them as a mixture or polycondensate.

The solvent used in the coating solution for forming the subbing layer may be arbitrarily selected from known organic solvents, such as alcohols, aromatic compounds, halogenated hydrocarbons, ketones, ketone alcohols, ethers, or esters. Specific examples thereof include ordinary organic solvents such as methanol, ethanol, n-propanol, iso-propanol, n-butanol, benzyl alcohol, methylcellusolve, ethylcellusolve, acetone, methyl ethyl ketone, cyclohexanone, methyl acetate, ethyl acetate, n-butyl acetate, dioxane, tetrahydrofuran, methylene chloride, chloroform, chlorobenzene, or toluene.

These solvents for dispersion may be used singly or in combination of two or more of them. In a case of a mixture of two or more solvents is used, any solvent can be used to the mixture as long as the resultant mixture solvent can dissolve the binder resin.

Known methods using a roll mill, a ball mill, a vibration ball mill, an attritor, a sand mill, a colloid mill, and a paint shaker may be used to disperse the metal oxide particles.

Examples of an application method for use in forming the subbing layer 2 include ordinary methods such as blade coating, wire bar coating, spray coating, dip coating, bead coating, air knife coating, or curtain coating.

The subbing layer 2 formed on the electrically conductive substrate 7 preferably has a Vickers' strength of about 35 or more. In addition, the subbing layer 2 preferably has a volume resistivity of about $10^6$ Ωcm to about $10^{13}$ Ωcm, that is more preferably in a range of about $10^8$ Ωcm to about $10^{12}$ Ωcm.

In a case where the volume resistivity is less than about $10^6$ Ωcm, drawbacks such as insufficient charge potential or leak resistance may occur, while in a case where the volume resistivity exceeds about $10^{13}$ Ωcm, stable electric potential property may not be obtained under repeating application.

While the subbing layer 2 may have any thickness as long as desired property can be obtained, the thickness thereof is preferably in a range of about 15 μm to about 50 μm, and is more preferably in a range of about 20 μm to about 50 μm.

In a case where the thickness of the subbing layer 2 is less than about 15 μm, there may cause a drawback of insufficient leak resistance, while the subbing layer having a thickness of more than about 50 μm may cause a drawback of leading to image density abnormalities due to residual electric potential easily remaining during long-term use.

For prevention of Moire images, the surface roughness of the subbing layer 2 is adjusted to about ¼n (n is the refractive index of an upper layer) of the wavelength λ of exposure laser beam used to about ½ of the wavelength λ. Resin particles may be contained in the subbing layer for adjustment of the surface roughness. The resin particles can be silicone resin particles and/or cross-linked PMMA resin particles.

In addition, the subbing layer 2 may be polished for adjustment of the surface roughness, and examples of polishing methods include buffing, sand blasting, wet honing, and grinding treatment.

In view of adjusting the light transmittance to the light having the first wavelength irradiated from the light emitting element 22A of the density measuring device 22 up to about 50% or greater, which is preferably from about 50% to about 95%, and in view of satisfying the relation expressed by Inequality (1), the dispersion state of the filler or the thickness of the subbing layer 2 can be appropriately controlled.

The control of the dispersion state of the filler can be carried out by, for example, adjusting a filler concentration, adjusting a filler diameter, blending plural kinds of fillers with diameters different from each other, or to proceed highly dispersing may be appropriate.

For example, increasing the filler concentration tends to be accompanied with reduction of transmittance, and enlarging the filler diameter tends to be accompanied with reduction of transmittance. Further, in the case where the plural kinds of filler with different diameters are used, the use of a larger amount of fillers with larger diameter tends to be accompanied with reduction of transmittance, and the larger amount of fillers with smaller diameter tends to be accompanied with elevation of transmittance. Accordingly, adjusting the blending ratio of plural kinds of fillers may enable to control the transmittance. In addition, a progress of dispersion process tends to be accompanied with elevation of transmittance.

An intermediate layer 4 may be formed between the subbing layer 2 and the photosensitive layer 3 for improvements in electrical properties, image quality, image quality endurance, and adhesiveness between the subbing layer and the photosensitive layer. Examples of the materials which can be used in the intermediate layer 4 include: polymer resin compounds such as acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, melamine resins; and organic metal compounds containing zirconium, titanium, aluminum, manganese, and/or silicon atoms. These compounds may be used singly or in combination of two or more of them as a mixture or polycondensate. Among them, a zirconium- or a silicon-containing organic metal compound is superior in various properties, since it has low residual electric potential and exhibits small fluctuations in electric potential caused by the environment and in electric potential caused by repeated use.

Examples of the silicon compound include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxylsilane, and γ-chloropropyltrimethoxysilane.

Examples of the silicon compound that is particularly favorably used among these include silane coupling agents such as vinyltriethoxylsilane, vinyltris(2-methoxyethoxy)silane, 3-methacryloxypropyltrimethoxysilane, 3-glycidoxypropyltrimethoxysilane, 2-(3,4-epoxycyclohexyl)ethyltrimethoxysilane, N-2-(aminoethyl)3-aminopropyltrimethoxysilane, N-2-(aminoethyl)-3-aminopropylmethyldimethoxysilane, 3-aminopropyltriethoxylsilane, N-phenyl-3-aminopropyltrimethoxysilane, 3-mercaptopropyltrimethoxysilane, or 3-chloropropyltrimethoxysilane.

Examples of the organic zirconium compound include zirconium butoxide, ethyl zirconium acetoacetate, zirconium triethanolamine, acetylacetonatozirconium butoxide, ethyl zirconium butoxide acetoacetate, zirconium acetate, zirconium oxalate, zirconium lactate, zirconium phosphonate, zirconium octanate, zirconium naphthenate, zirconium laurate, zirconium stearate, zirconium isostearate, methacrylatozirconium butoxide, stearatozirconium butoxide and isostearatozirconium butoxide.

Examples of the organic titanium compound include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethylester, titanium triethanol aminate, and polyhydroxytitanium stearate.

Examples of the organic aluminum compound include aluminum isopropylate, monobutoxyaluminum diisopropylate, aluminum butylate, diethylacetoacetatoaluminum diisopropylate, and aluminum tris(ethylacetoacetate).

The intermediate layer 4 not only improves the coating properties of layers on or above the intermediate layer but also serves as an electrical blocking layer. However, in a case where the thickness of the intermediate layer is too large, it may become more electrically resistant, leading to a decrease in sensitivity of the photoreceptor and an increase in electric potential due to repeated use. Accordingly, when the intermediate layer 4 is formed, the intermediate layer 4 preferably has a thickness in the range of about 0.1 μm to about 5 μm.

Details of the photosensitive layer 3 is explained herein.

The charge generating layer 31 in the photosensitive layer 3 can be formed by vacuum-depositing a charge generating material or by coating a dispersion containing a charge generating material. Specifically, when the charge generating layer 31 can be formed by the coating a dispersion, the charge generating material is dispersed together with a binder resin, an additive and the like in an organic solvent, and coating the thus obtained dispersion.

As described above, the photosensitive layer 3 does not have absorption with respect to light having the first wavelength irradiated from the light emitting element 22A of the density measuring device 22, but it has absorption with respect to light having the second wavelength irradiated from the exposing device 18 and being different from the first wavelength.

In order to configure the photosensitive layer 3 as described above, a charge generating material for composing a charge generating layer 31 can be selected from those having no absorption with respect to light having the first wavelength irradiated from the light emitting element 22A of the density measuring device 22 but having absorption with respect to light having the second wavelength irradiated from the exposing device 18 and being different from the first wavelength.

The kind of the charge generating material may depend on the value of the first wavelength. In a case where the first wavelength is in a range of about 920 nm to about 1,000 nm, and the second wavelength is in a range of about 350 nm to about 900 nm, examples thereof include phthalocyanine pigments, squarylium compounds, bisazo compounds, trisazo pigments, perylene compounds, and dithioketopyrrolopyrrole. Examples of those for visible light include condensed polycyclic pigments, bisazo compounds, perylene compounds, trigonal selenium compounds, and dye-sensitized zinc oxide fine particles. Charge generating materials providing excellent properties and therefore particularly favorably used are phthalocyanine pigments and azo pigments. Use of a phthalocyanine pigment enables production of the photoreceptor 12 having particularly superior sensitivity and stability during repeated use.

Phthalocyanine pigments and azo pigments generally have several crystal forms. A phthalocyanine or azo pigment having any of these crystal forms may be used, as long as it can provide desirable electrophotographic properties. Specific examples of the phthalocyanine pigment include chlorogallium phthalocyanine, dichlorotin phthalocyanine, hydroxygallium phthalocyanine, metal-free phthalocyanine, oxytitanylphthalocyanine, and chloroindium phthalocyanine.

The phthalocyanine pigment crystals may be prepared by mechanical, dry pulverization of a phthalocyanine pigment prepared in accordance with a known method with an automatic mortar, a planetary mill, a vibration mill, a CF mill, a roller mill, a sand mill and/or a kneader, and optionally by wet pulverization of the crystal obtained by the dry pulverization in a solvent with a ball mill, a mortar, a sand mill and/or a kneader.

Examples of the solvent used in the process described above include aromatic compounds (e.g., toluene, and chlorobenzene), amides (e.g., dimethylformamide, and N-methylpyrrolidone), aliphatic alcohols (e.g, methanol, ethanol, and butanol), aliphatic polyhydric alcohols (e.g., ethylene glycol, glycerol, and polyethylene glycol), aromatic alcohols (e.g., benzyl alcohol, and phenethyl alcohol), esters (e.g., acetic acid esters, including butyl acetate), ketones (e.g., acetone, and methyl ethyl ketone), dimethylsulfoxide, and ethers (e.g., diethyl ether, and tetrahydrofuran), and mixtures thereof, and mixtures each including at least one of these organic solvents and water. The amount of the solvent is in the range of about 1 parts to about 200 parts, and preferably about 10 parts to about 100 parts by weight with respect to the pigment crystals. The processing temperature is in the range of about −20° C. to the boiling point of the solvent and more preferably in the range of about −10° C. to about 60° C. A grinding aid such as sodium chloride or Glauber's salt may be additionally used during pulverization. The amount of the grinding aid is about 0.5 time to about 20 times, and preferably about 1 time to about 10 times as much as that of the pigment.

The crystalline state of phthalocyanine pigment crystal prepared in accordance with a known method can be controlled with acid pasting or a combination of the acid pasting and the dry or wet pulverization described above. An acid for use in the acid pasting is preferably sulfuric acid at a concentration of about 70% to about 100%, and preferably of about 95% to about 100%. The solubilization temperature is in the range of about −20° C. to about 100° C. and preferably in the range of about −1° C. to about 60° C. The amount of conc. sulfuric acid is about 1 time to about 100 times, and preferably about 3 times to about 50 times as much as that of phthalocyanine pigment crystal. Water or a mixture of water and an organic solvent is used in an arbitrary amount as a solvent for precipitating the crystal. The precipitation temperature is not particularly limited, but the pigment crystals are preferably cooled, for example, with ice for prevention of heat generation.

Hydroxygallium phthalocyanine, which can be used as one of those most preferably used among them, has diffraction peaks at Bragg angles (2θ±0.2°) of 7.5°, 9.9°, 12.5°, 16.3°, 18.6°, 25.1°, and 28.3° as determined by using X-ray having Cukα characteristics. I-type hydroxygallium phthalocyanine used as a raw material in preparation of hydroxygallium phthalocyanine can be prepared in accordance with any known method. One example thereof is shown below.

First, crude gallium phthalocyanine is produced, for example, by a method of reacting o-phthalodinitrile or 1,3-diiminoisoindoline with gallium trichloride in a predetermined solvent (I-type chlorogallium phthalocyanine method); or a method of preparing phthalocyanine dimer by heating and allowing o-phthalodinitrile, an alkoxy gallium, and ethylene glycol to react in a predetermined solvent (phthalocyanine dimer method). Examples of the solvent preferably used in the above reactions include inactive, high-boiling point solvents such as α-chloronaphthalene, β-chloronaphthalene, α-methylnaphthalene, methoxynaphthalene, dimethylaminoethanol, diphenylethane, ethylene glycol, dialkylethers, quinoline, sulfolane, dichlorobenzene, dimethylformamide, dimethylsulfoxide, or dimethylsulfoamide.

The crude gallium phthalocyanine thus obtained is then subjected to acid pasting treatment, which converts the crude gallium phthalocyanine into fine particles of I-type hydroxygallium phthalocyanine pigment. Specifically, the acid pasting treatment is recrystallization of gallium phthalocyanine, for example, by pouring a solution in which the crude gallium phthalocyanine is dissolved in an acid such as sulfric acid into an aqueous alkaline solution, water or ice water, or by adding an acid salt of the crude gallium phthalocyanine such as a sulfate salt to the aqueous alkaline solution, water or ice water. The acid used in the acid pasting treatment is preferably sulfuric acid, and the sulfuric acid preferably has a concentration of about 70% to about 100% (more preferably about 95% to about 100%).

The hydroxygailium phthalocyanine usable in the invention can be obtained by pulverizing the 1-type hydroxygallium phthalocyanine pigment obtained by the acid pasting treatment in a solvent and thus altering the crystal form of the pigment. This wet pulverization treatment is preferably carried out with a pulverizer employing spherical media having an outer diameter of about 0.1 mm to about 3.0 mm, more preferably employing those having an outer diameter of about 0.2 mm to about 2.5 mm. If the outer diameter of the media is greater than about 3.0 mm, pulverization efficiency deteriorates and the hydroxygallium phthalocyanine particles do not become smaller and easily aggregate. Alternatively, if it is less than about 0.1 mm, it becomes difficult to separate hydroxygallium phthalocyanine powder from the media. In addition, when the media have a shape other than sphere such as a cylindrical or irregular shape, pulverization efficiency lowers, and the media easily wear due to pulverization, and fractured powders occurring from wear of the media serves as impurities and accelerate deterioration of the properties of hydroxygallium phthalocyanine.

Any material may be used for the media, but the media is preferably made of what never or hardly causes image quality defects even when introduced into the pigment, such as glass, zirconia, alumina, or agate.

Any material may be used for the container, but the container is preferably made of what never or hardly causes image quality defects even when introduced into the pigment, such as glass, zirconia, alumina, agate, polypropylene, TEFLON (registered trade name), or polyphenylene sulfide. Further, the internal surface of a container made of a metal such as iron or stainless steel may be lined with glass, polypropylene, TEFLON (registered trade name) or polyphenylene sulfide.

The amount of the media used may depend on the type of a device used, but is generally about 50 parts by weight or more, and preferably about 55 parts to about 100 parts by weight with respect to 1 part by weight of I-type hydroxygallium phthalocyanine pigment. When the weight of the media is constant, a decrease in the outer diameter of the media leads to an increase in the density of the media in the device, an increase in the viscosity of the mixture solution and a change in pulverization efficiency. Therefore, it is preferable to conduct wet pulverization at a controlled, optimal mixing rate of the amounts of the media and the solvents used, as the medium outer diameter is reduced.

The temperature of the wet pulverization treatment is generally in the range of about 0° C. to about 100° C., preferably in the range of about 5° C. to about 80° C., and more preferably in the range of about 10° C. to about 50° C. Wet pulverization at a lower temperature may result in slowdown of crystal conversion, while that at an excessively high temperature may result in an increase in the solubility of hydroxygallium phthalocyanine and crystal growth, making it difficult to produce fine particles.

Examples of the solvent for use in the wet pulverization treatment include amides such as N,N-dimethylformamide, N,N-dimethylacetamide, or N-methylpyrrolidone; esters such as ethyl acetate, n-butyl acetate, or iso-amyl acetate; ketones such as acetone, methyl ethyl ketone, or methyl isobutyl ketone; and dimethylsulfoxide. The amount of the solvent used is usually about 1 part to about 200 parts by weight, and preferably about 1 part to about 100 parts by weight with respect to 1 part by weight of the hydroxygallium phthalocyanine pigment.

Examples of an apparatus used in the wet pulverization treatment include mills employing a dispersion medium such as a vibration mill, an automatic mortar, a sand mill, a dyno mill, a coball mill, an attritor, a planetary ball mill, or a ball mill.

The progress speed of the crystal conversion can be significantly influenced by the scale, agitating speed and the material of the media of the wet pulverization process. The process is continued until the original crystal form of hydroxygallium phthalocyanine is converted to the desired crystal form thereof. At this time, the crystal-converting state of hydroxygallium phthalocyanine is monitored by measuring the light absorption of the solution, which is being subjected to wet pulverization. The process is continued until the absorption peak of the hydroxygallium phthalocyanine which absorption peak is maximum in the spectroscopic absorption spectrum of about 600 nm to about 900 nm becomes within the range of about 810 nm to about 839 nm. Generally, the duration of the wet pulverization treatment is generally in the range of about 5 hours to about 500 hours and preferably in the range of about 7 hours to about 300 hours. A treatment period of shorter than about 5 hours may result in incomplete crystal conversion, leading to deterioration in electrophotographic properties, in particular, in sensitivity. A treatment period of longer than about 500 hours may cause decreases in sensitivity and productivity, and contamination of the pigment with fractured powder of the medium due to the influence of pulverization stress. Wet pulverization continued for the period of time described above allows the hydroxygallium phthalocyanine particles to be uniformly pulverized and converted into fine particles.

The binder resin for use in the charge generating layer 31 may be selected from a wide variety of insulating resins or from organic photoconductive polymer such as poly-N-vinylcarbazole, polyvinylanthracene, polyvinylpyrene, and polysilane. Specific examples of the binder resin include, but are not limited to, polyvinylacetal resins, polyarylate resins (e.g., poly-condensed polymers made from bisphenol A and phthalic acid), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins and polyvinylpyrrolidone resins. One of these binder resins may be used alone, or two or more of them can be used as a mixture. Among them, polyvinyl acetal resin is particularly preferably used in the charge generating layer 31.

The blending ratio (weight ratio) of the charge generating material to the binder resin in the coating solution for forming a charge generating layer is preferably in the range of about 10:1 to about 1:10. The solvent used in the coating solution may be selected arbitrarily from known organic solvents such as alcohols, aromatic compounds, halogenated hydrocarbons, ketones, ketone alcohols, ethers, and esters. Specific examples thereof include ordinary organic solvents such as methanol, ethanol, n-propanol, iso-propanol, n-butanol, benzyl alcohol, methylcellusolve, ethylcellusolve, acetone, methyl ethyl ketone, cyclohexanone, methyl acetate, ethyl acetate, n-butyl acetate, dioxane, tetrahydrofuran, methylene chloride, chloroform, chlorobenzene, or toluene.

These solvents for use in dispersion may be used singly, or in combination of two or more of them as a mixture. When two or more solvents are mixed, these are selected such that the mixed solvent can dissolve the binder resin.

Examples of the method for the dispersing include methods using a roll mill, a ball mill, a vibration ball mill, an attritor, a sand mill, a colloid mill or a paint shaker. The method for applying a coating solution for the charge generating layer to the subbing layer or the intermediate layer can be any common method including blade coating, wire bar coating, spray coating, dip coating, bead coating, air knife coating and curtain coating methods.

Further, it is effective to adjust the size of dispersed particles to a value in the range of about 0.5 μm or less, preferably about 0.3 μm or less, and more preferably about 0.15 μm or less in improving sensitivity and stability.

The charge generating material may be surface-treated for improvement in the stability of electrical properties and prevention of image quality defects. Such surface treatment improves dispersing property of the charge generating material and coatability of the coating solution for a charge generating layer, enables easy and secure production of a smooth charge generating layer 31 in which the substance is uniformly dispersed, consequently suppresses image quality defects such as fogging and ghosts, and thus improves image quality endurance. It may also improve the storage life of the coating solution for a charge generating layer and thus may be effective in extending the pot life thereof, enabling cost reduction of the photoreceptor.

An organic metal compound or a silane coupling agent having a hydrolyzable group may be used as the surface-treating agent.

The organic metal compound or the silane coupling agent having a hydrolyzable group is preferably represented by the following Formula (A):

$$Rp\text{-}M\text{-}Yq \qquad \text{Formula (A)}$$

In the formula, R represents an organic group; M represents a metal other than an alkali metal, or a silicon atom; Y represents a hydrolyzable group; and p and q each are an integer of 1 to 4 and the total of p and q is equivalent to the valence of M.

Examples of the organic group represented by R in Formula (A) include alkyl groups such as methyl, ethyl, propyl, butyl, and octyl groups; alkenyl groups such as vinyl and allyl groups; cycloalkyl groups such as a cyclohexyl group; aryl groups such as phenyl and naphthyl groups; alkylaryl groups such as a toluyl group; arylalkyl groups such as benzyl and phenylethyl group; arylalkenyl groups such as a styryl group; and heterocyclic residues such as furyl, thienyl, pyrrolidinyl, pyridyl, and imidazolyl groups. The organic group may have one or more substituents.

Examples of the hydrolyzable group represented by Y in Formula (A) include ether groups such as methoxy, ethoxy, propoxy, butoxy, cyclohexyloxy, phenoxy, or benzyloxy group; ester groups such as acetoxy, propionyloxy, acryloxy, methacryloxy, benzoyloxy, methanesulfonyloxy, benzenesulfonyloxy, or benzyloxycarbonyl groups; and halogen atoms such as a chlorine atom.

In Formula (A), while M is not particularly limited as long as it is other than an alkali metal. M is preferably a titanium atom, an aluminum atom, a zirconium atom, or a silicon atom. Accordingly, organic titanium compounds, organic aluminum compounds, organic zirconium compounds, and silane coupling agents which are substituted with the organic group or hydrolyzable group described above are preferably used in one embodiment of the invention.

Examples of the silane coupling agent include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane and γ-chloropropyltrimethoxysilane. Preferable examples thereof among these include vinyltriethoxysilane, vinyltris(2-methoxyethoxy)silane, 3-methacryloxypropyltrimethoxysilane, 3-glycidoxypropyltrimethoxysilane, 2-(3,4-epoxycyclohexyl)ethyltrimethoxysilane, N-2-(aminoethyl)-3-aminopropyltrimethoxysilane, N-2-(aminoethyl)-3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane.

Examples of the organic zirconium compound include zirconium butoxide, ethyl zirconium acetoacetate, zirconium triethanolamine, acetylacetonatozirconium butoxide, ethyl zirconium butoxide acetoacetate, zirconium acetate, zirconium oxalate, zirconium lactate, zirconium phosphonate, zirconium octanate, zirconium naphthenate, zirconium laurate, zirconium stearate, zirconium isostearate, methacrylatozirconium butoxide, stearatozirconium butoxide and isostearatozirconium butoxide.

Examples of the organic titanium compound include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanol aminate, and polyhydroxytitanium stearate. Examples of the organic aluminum compound include aluminum isopropylate, monobutoxyaluminum diisopropylate, aluminum butylate, diethylacetoacetatoaluminum diisopropylate, and aluminum tris(ethylacetoacetate).

Hydrolysates of the organic metal compounds and the silane coupling agents may also be used. Examples of the hydrolysate include those in which Y (hydrolyzable group) bonding to M (a metal atom other than an alkali metal, or a silicon atom) in the organic metal compound represented by the formula described above and/or an hydrolyzable group bonding to R (organic group) has been hydrolyzed. In this case, if the organic metal compound or the silane coupling agent has plural hydrolyzable groups, it is unnecessary that all the functional groups on the compound have been hydrolyzed. In other words, a partially hydrolyzed product may be used in the invention. One of these organic metal compounds and the silane coupling agents may be used alone, or two or more of them can be used together.

Examples of a method for coating a phthalocyanine pigment with an organic metal compound and/or a silane coupling agent having a hydrolyzable group (hereinafter, referred to simply as "organic metal compound") include a method for coating the phthalocyanine pigment with the agent at the time that the crystal form of the phthalocyanine pigment is being changed, a method for conducting the coating treatment before the phthalocyanine pigment is dispersed in the binder resin, a method for mixing the organic metal compound with the pigment in dispersing the phthalocyanine pigment in the binder resin, and a method for dispersing an organic metal compound in a binder resin in which the phthalocyanine pigment has been dispersed.

More specifically, examples of the method for conducting the coating treatment at the time that the crystal form of the phthalocyanine pigment is being changed include a method for mixing the organic metal compound with the phthalocyanine pigment whose crystal form has not been changed and heating the resultant mixture, a method for mixing the organic metal compound with the phthalocyanine pigment whose crystal form has not been changed and mechanically pulverizing the resultant mixture in a dry manner, and a method for mixing a liquid mixture in which the organic metal compound is dissolved in water or an organic solvent with the phthalocyanine pigment whose crystal form has not been changed and conducting wet-pulverization treatment.

Examples of the method for conducting the coating treatment before the phthalocyanine pigment is dispersed in the binder resin include a method for mixing the organic metal compound, water or a liquid mixture of water and an organic solvent, and the phthalocyanine pigment and heating the resultant mixture, a method for directly spraying the organic metal compound on the phthalocyanine pigment, and a method for mixing and milling the organic metal compound and the phthalocyanine pigment.

Further, examples of the method for mixing the organic metal compound with the pigment in dispersing the phthalocyanine pigment in the binder resin include a method for sequentially adding the organic metal compound, the phthalocyanine pigment, and the binder resin to a dispersion solvent and stirring the resultant mixture, and a method for simultaneously adding these components of a charge generating layer to a solvent and mixing the resultant.

Various additives may be added to the coating solution for a charge generating layer to improve electrical properties of the layer and image quality. The additives can be known materials. Examples thereof include electron transport materials including quinone compounds such as chloranil, bromoanil, and anthraquinone, tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone compounds, thiophene compounds, diphenoquinone compounds such as 3,3',5,5'-tetra-t-butyl diphenoquinone; electron transport pigments such as polycyclic condensed compounds, and azo pigments; zirconium chelate compounds, titanium chelate compounds, aluminum chelate compounds, titanium alkoxide compounds, organic titanium compounds, and silane coupling agents.

Examples of the silane coupling agent include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane and γ-chloropropyltrimethoxysilane.

Examples of the zirconium chelate compound include zirconium butoxide, ethyl zirconium acetoacetate, zirconium triethanolamine, acetylacetonatozirconium butoxide, ethyl zirconium butoxide acetoacetate, zirconium acetate, zirconium oxalate, zirconium lactate, zirconium phosphonate, zirconium octanate, zirconium naphthenate, zirconium laurate, zirconium stearate, zirconium isostearate, methacrylatozirconium butoxide, stearatozirconium butoxide and isostearatozirconium butoxide.

Examples of the titanium chelate compound include tetraisopropyl titanate, tetra-n-butyl titanate, butyl titanate dimer, tetra(2-ethylhexyl)titanate, titanium acetylacetonate, polytitanium acetylacetonate, titanium octyleneglycolate, titanium lactate ammonium salt, titanium lactate, titanium lactate ethyl ester, titanium triethanol aminate, and polyhydroxytitanium stearate.

Examples of the aluminum chelate compound include aluminum isopropylate, monobutoxyaluminum diisopropylate, aluminum butylate, diethylacetoacetatoaluminum diisopropylate and aluminum tris(ethylacetoacetate).

These compound may be used singly, or in combination of two or more of them as a mixture or a polycondensate.

A method for applying a coating solution for a charge generating layer 31A to the undercoat or intermediate layer can be an ordinary method. Examples thereof include blade coating, wire bar coating, spray coating, dip coating, bead coating, air knife coating and curtain coating methods.

A silicone oil may also be added in a trace amount to the coating solution as the leveling agent to improve the smoothness of the resultant coated film. The thickness of the charge generating layer 31 is preferably about 0.05 μm to about 5 μm and more preferably about 0.1 μm to about 2.0 μm.

The charge transporting layer 32 can be a layer produced by a known technique. The charge transporting layer contains a charge transport material and a binder resin or a polymeric charge transport material.

Any known compound may be used as the charge transport material contained in the charge transporting layer 32 and examples thereof include hole transport materials including modified compounds of oxadiazole such as 2,5-bis(p-diethyl aminophenyl)-1,3,4-oxadiazole, modified compounds of pyrazoline such as 1,3,5-triphenyl-pyrazoline or 1-[pyridyl-(2)]-3-(p-diethylaminostyryl)-5-(p-diethylaminostyryl) pyrazoline, aromatic tertiary amino compounds such as triphenylamine, tri(p-methyl)phenylamine, N,N'-bis(3,4-dimethylphenyl)biphenyl-4-amine, dibenzylaniline, or 9,9-dimethyl-N,N'-dip-tolyl)fluorenone-2-amine, aromatic tertiary diamino compounds such as N,N'-diphenyl-N,N'-bis(3-methylphenyl)-[1,1-biphenyl]-4,4'-diamine, 1,2,4-triazine compounds such as 3-(4'-dimethylaminophenyl)-5,6-di(4'-methoxyphenyl)-1,2,4-triazine, hydrazone compounds such as 4-diethylaminobenzaldehyde-1,1-diphenylhydrazone, 4-diphenylaminobenzaldehyde-1,1-diphenylhydrazone, or [p-(diethylamino)phenyl](1-naphthyl)phenylhydrazone, modified compounds of quinazoline such as 2-phenyl-4-styryl-quinazoline, modified compounds of benzofuran such as 6-hydroxy-2,3-di(p-methoxyphenyl)-benzofuran, α-stilbene compounds such as p-(2,2-diphenylvinyl)-N,N'-diphenyl aniline, enamine compounds, carbazole compounds such as N-ethylcarbazole, and poly-N-vinylcarbazole and modified compounds thereof; electron transport materials including quinone compounds such as chloranil, bromoanil, or anthraquinone, tetracyanoquinodimethane compounds, fluorenone compounds such as 2,4,7-trinitrofluorenone or 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone compounds, thiophene compounds, and diphenoquinone compounds such as 3,3',5,5'-tetra-t-butyldiphenoquinone. In addition, a polymer having a group containing the compound described above in the main or side chain can also be used as the charge transport material. One of these charge transport materials may be used alone, or two or more of them can be used together.

Among them, the charge control material is preferably a compound represented by any of the following Formulae (B-1) to (B-3) from the viewpoint of mobility.

(B-1)

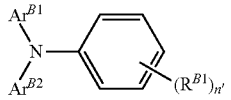

In Formula (B-1), $R^{B1}$ represents a methyl group, and n is an integer of 0 to 2. $Ar^{B1}$ and $Ar^{B2}$ each represent a substituted or unsubstituted aryl group; and the substituent group represents a halogen atom, an alkyl group having 1 to 5 carbon atoms, an alkoxy group having 1 to 5 carbon atoms, or a substituted amino group having as a substituent an alkyl group having 1 to 3 carbon atoms.

(B-2)

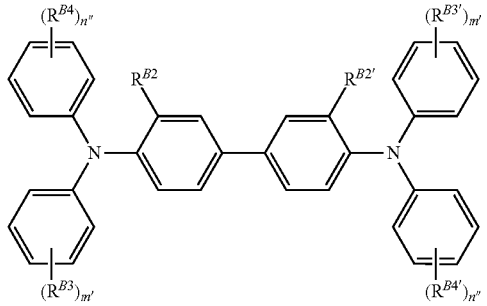

In Formula (B-2), $R^{B2}$ and $R^{B2'}$ may be the same or different and each independently represent a hydrogen atom, a halogen atom, an alkyl group having 1 to 5 carbon atoms, or an alkoxy group having 1 to 5 carbon atoms. $R^{B3}$, $R^{B3'}$, $R^{B4}$, and $R^{B4'}$ may be the same or different and each independently represent a hydrogen atom, a halogen atom, an alkyl group having 1 to 5 carbon atoms, an alkoxy croup having 1 to 5 carbon atoms, an amino group having as a substituent an alkyl group having one or two carbon atoms, a substituted or unsubstituted aryl group, or, —C($R^{B5}$)═C($R^{B6}$)($R^{B7}$); $R^{B5}$, $R^{B6}$, and $R^{B7}$ each represent a hydrogen atom, a substituted or unsubstituted alkyl group, or a substituted or unsubstituted aryl group. m' and n" are integers of 0 to 2.

or —CH═CH—CH═C($Ar^{B3}$). $Ar^{B3}$ represents a substituted or unsubstituted aryl group. $R^{B9}$ and $R^{B10}$ may be the same or different and each independently represent a hydrogen atom, a halogen atom, an alkyl group having 1 to 5 carbon atoms, an alkoxy group having 1 to 5 carbon atoms, an amino group having as a substituent an alkyl group having one or two carbon atoms, or a substituted or unsubstituted aryl group.

Any known binder resin may be contained in the charge transporting layer 32, but a resin that can form an electrically insulating film is preferable. Examples of the binder resin include, but are not limited to, insulating resins such as polycarbonate resins, polyester resins, polyarylate resins, methacrylic resins, acrylic resins, polyvinyl chloride resins, polyvinylidene chloride resins, polystyrene resins, acrylonitrile-styrene copolymers, acrylonitrile-butadiene copolymers, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride terpolymers, silicone resins, silicone-alkyd resins, phenol-formaldehyde resins, styrene-alkyd resins, poly-N-carbazole, polyvinylbutyral, polyvinylformal, polysulfone, casein, gelatin, polyvinyl alcohol, ethylcellulose, phenol resins, polyamide, polyacrylamide, carboxymethylcellulose, vinylidene chloride polymer waxes, and polyurethane; and organic photoconductive polymers such as polyvinyl carbazole, polyvinyl anthracene, polyvinyl pyrene, polysilane, and polyester polymeric charge transport materials described in JP-A Nos. 8-176293 and 8-208820. One of these binder resins is used alone, or two or more of them can be used as a mixture. In particular, the binder resin is preferably a polycarbonate resin, a polyester resin, a methacrylic resin, and/or an acrylic resin, since it has good compatibility with the charge transport material, solubility in a solvent, and strength. The blending ratio (weight ratio) of the binder resin to the charge transport material may be determined, considering deterioration in electrical properties and film strength.

An organic photoconductive polymer may be contained singly in the charge transporting layer. The organic photoconductive polymer can be known one having a charge transport property such as poly-N-vinylcarbazole or polysilane. The polyester polymeric charge transport materials described in JP-A Nos. 8-176293 and 8-208820 have a high charge transport property and thus are particularly preferable. The polymeric charge transport material may be contained alone in the charge transporting layer 32, but the layer can be made of such a material and the binder resin.

(B-3)

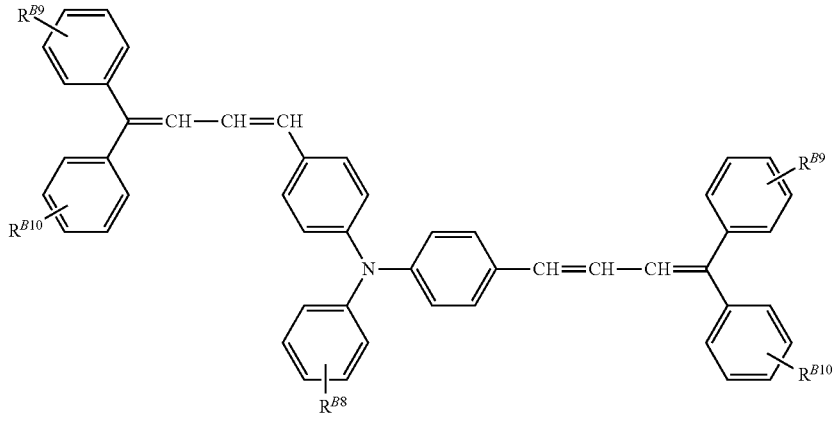

In Formula (B-3), $R^{B8}$ represents a hydrogen atom, an alkyl group having 1 to 5 carbon atoms, an alkoxy group having 1 to 5 carbon atoms, a substituted or unsubstituted aryl group, When the charge transporting layer 32 is the surface layer of the electrophotographic photoreceptor (one of the layers constituting the photosensitive layer which one is the farthest from the electrically conductive substrate), lubricant particles (for example, silica particles, alumina particles, fluorinated resin particles such as polytetrafluoroethylene (PTFE) particles, and silicone resin fine particles) are preferably added to the charge transporting layer 32 to provide the film with lubricity, make the surface layer more resistant to abrasion and scratch, and improve removal of a developer adhered to and remaining on the photoreceptor surface. Two or more types of these lubricant particles may be used as a mixture. The lubricant particles are preferably fluorinated resin particles.

The fluorinated resin particles are preferably made of one or more resins selected from tetrafluoroethylene resins, trifluorochloroethylene resins, hexafluoropropylene resins, vinyl fluoride resins, vinylidene fluoride resins, dichlorodifluoroethylene resins, and copolymers thereof. Among them, the fluorinated resin is more preferably made of a tetrafluoroethylene resin and/or a vinylidene fluoride resin.

The primary particle diameter of the fluorinated resin particles is preferably about 0.05 μm to about 1 μm and more preferably about 0.1 μm to about 0.5 μm. Particles having a primary particle diameter of less than about 0.05 μm are more likely to aggregate during or after dispersion. Meanwhile, particles of larger than about 1 μm may cause image quality defects more frequently.

The content of the fluorinated resin in the charge transporting layer containing the fluorinated resin is suitably about 0.1 weight % to about 40 weight %, and more preferably about 1 weight % to about 30 weight % with respect to the total amount of the charge transporting layer. When the fluorinated resin particles are contained at a content of less than about 0.1 weight %, the modification effect by dispersion of the fluorinated resin particles may become insufficient. When the fluorinated resin particles are contained at a content of more than about 40 weight %, light-transmitting property may decrease, and residual electric potential on the resulting photoreceptor may increase due to repeated use.

The charge transporting layer 32 can be formed by dissolving the charge transporting material, a binder resin, and other materials in a suitable solvent, applying the resultant coating solution for a charge transporting layer to the subbing layer, the intermediate layer or the charge generating layer, and drying the resultant coating.

Examples of the solvent for use in forming the charge transporting layer 32 include aromatic hydrocarbon solvents such as toluene and chlorobenzene; aliphatic alcohol solvents such as methanol, ethanol, and n-butanol; ketone solvents such as acetone, cyclohexanone, and 2-butanone; halogenated aliphatic hydrocarbon solvents such as methylene chloride, chloroform, and ethylene chloride; cyclic- or linear ether solvents such as tetrahydrofuran, dioxane, ethylene glycol, and diethyl ether; and mixed solvents thereof. The blending ratio of the charge transport material to the binder resin (the charge transport material: the binder resin) is preferably about 10:1 to about 1:5.

In addition, a leveling agent such as silicone oil may be added in a trace amount to the coating solution for a charge transporting layer for improvement in smoothness of the resultant coated film.

The fluorinated resin can be dispersed in the charge transporting layer 32 with a roll mill, a ball mill, a vibration ball mill, an attritor, a sand mill, a high-pressure homogenizer, an ultrasonic dispersing machine, a colloid mill, a colliding medium-less dispersing machine and/or a penetrating medium-less dispersing machine.

For example, a method of dispersing the fluorinated resin particles in a solution of a binder resin and a charge transport material is employed for dispersion of the particles in the coating solution for a charge transporting layer 32.

In the producing of the coating solution for a charge transporting layer 32, the temperature of the coating solution is preferably controlled in the range of about 0° C. to about 50° C.

Various methods including cooling the coating solution with water, air, or a refrigerant, controlling room temperature in the production process, heating the coating solution with hot water, hot air or a heater, and using a facility for producing the coating solution made of a material which hardly generates heat, easily releases heat, or easily accumulates heat may be used for that purpose. It is effective to add a small amount of a dispersion aid for improving stability of the dispersion and preventing aggregation during film formation to the coating solution. Examples of the dispersion aid include fluorochemical surfactants, fluorinated polymers, silicone polymers and silicone oils.

Moreover, it is also effective to disperse, agitate, or mix a fluorinated resin and a dispersion aid in a small amount of a dispersion solvent, agitate the resultant mixture, mix the mixture with a solution in which a charge transport material and a binder resin in a dispersion solvent, and stir the resulting mixture in accordance with the method described above.

Various methods such as dip coating, push-up coating, spray coating, roll coater coating, wire bar coating, gravure coater coating, bead coating, curtain coating, blade coating or air knife coating methods may be used for application of the coating solution for the charge transporting layer 32.

The thickness of the charge transporting layer 32 is preferably about 5 μm to about 50 μm, and more preferably about 10 μm to about 40 μm.

The photosensitive layer 3 of the photoreceptor 12 used in one embodiment of the invention may contain any additive such as an antioxidant or a photostabilizer to prevent the electrophotographic photoreceptor from being damaged by ozone and oxidizing gas generated in an electrophotographic system, light and/or heat.

Examples of the antioxidant include hindered phenols, hindered amines, p-phenylenediamine, arylalkanes, hydroquinone, spirochromane, and spiroindanone, and modified compounds thereof, organic sulfur-containing compounds and organic phosphorus-containing compounds.

Specific examples of the phenol antioxidant include 2,6-di-t-butyl-4-methylphenol, styrenated phenols, N-octadecyl-3-(3',5'-di-t-butyl-4'-hydroxyphenyl)propionate, 2,2-methylene-bis-(4-methyl-6-t-butylphenol), 2-t-butyl-6-(3'-t-butyl-5'-methyl-2-hydroxybenzyl)-4-methylphenyl acrylate, 4,4'-butylidene-bis-(3-methyl-6-t-butylphenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3',5'-di-t-butyl-4-hydroxy-phenyl)propionato]-methane, and 3,9-bis[2-[3-(3-t-butyl-4-hydroxy-5-methylphenyl) propionyloxy]-1,1-dimethylethyl]-2,4,8,10-tetraoxaspiro[5,5]undecane.

Specific examples of the hindered amine compound include bis(2,2,6,6-tetramethyl-4-pyperidyl)sebacate, bis(1,2,2,6,6-pentamethyl-4-pyperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecan-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensates, poly [{6-(1,1,3,3-tetramethylbutyl)imino-1,3,5-triazine-2,4-di-imyl}{(2,2,6,6-tetramethyl-4-pyperidyl)imino}hexamethylene{(2,3,6,6,-tetramethyl-4-pyperidyl)imino}], bis(1,2,2,6,6-pentamethyl-4-pyperidyl) 2-(3,5-di-t-butyl-4-hydroxybenzyl)-2-n-butyl malonate, and N,N'-bis(3-aminopropyl)ethylenediamine-2,4-bis[N-butyl-N-(1,2,2,6,6-pentamethyl-4-pyperidyl)amino]-6-chloro-1,3,5-triazine condensates.

Specific examples of the organic sulfur-containing antioxidant include dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, and 2-mercaptobenzimidazole.

Specific examples of the organic phosphorus-containing antioxidant include trisnonylphenyl phosphite, triphenyl phosphite, and tris(2,4-di-t-butylphenyl)phosphite.

The organic sulfur- and phosphorus-containing antioxidants are called secondary antioxidants, and such an antioxidant shows synergism when used in combination with the phenol or amine primary antioxidant.

Examples of the photostabilizer include benzophenone compounds, benzotriazole compounds, dithiocarbamate compounds, and tetramethyl piperidine compounds.

Examples of the benzophenone photostabilizer include 2-hydroxy-4-methoxybenzophenone, 2-hydroxy-4-octoxybenzophenone, and 2,2'-di-hydroxy-4-methoxybenzophenone. Examples of the benzotriazole photostabilizer include 2-(2'-hydroxy-5'-methylphenyl)-benzotriazole, 2-[2'-hydroxy-3'-(3",4",5",6"-tetra-hydrophthalimido-methyl-)-5'-methylphenyl]-benzotriazole, 2-(2'-hydroxy-3'-t-butyl-5'-methylphenyl-)-5-chlorobenzotriazole, 2-(2'-hydroxy-3',5'-di-t-butylphenyl)benzotriazole, 2-(2'-hydroxy-5'-t-octylphenyl)-benzotriazole, and 2-(2'-hydroxy-3',5'-di-t-amylphenyl)benzotriazole.

Examples of other photostabilizers include 2,4-di-t-butylphenyl-3',5'-di-t-butyl-4'-hydroxy benzoate, and nickel dibutyl-dithiocarbamate.

The coating solution for the charge transporting layer may contain at least one electron-accepting material for improvement in sensitivity, and reduction in residual electric potential and fatigue during repeated use Examples of the electron-accepting material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, m-nitrobenzoic acid, and phthalic acid. Preferable examples among these include a fluorenone compound, a quinone compound and a benzene compound having an electron-attractive substituent such as Cl, CN, or $NO_2$.

A protective layer 5 can be used in the photoreceptor 12 having a multi-layer structure to prevent the charge transporting layer from chemically changing during charging, improve mechanical strength of the photoreceptor 12, and improve resistance of the surface layer of the photoreceptor 12 to abrasion, scratch and the like.

A protective layer 5 can be further formed over the charge transpoting layer 32 in view of preventing a chemical change of the charge transpoting layer 32 during charging, improving mechanical strength of the photosensitive layer 3, and the like.

The protective layer 5 is configured by containing a binder resin (including a curable resin) and a charge transporting compound. The protective layer 5 is in the form of a resin-cured film made from the curable resin and or the charge transport compound, or a film made of a suitable binder resin and an electrically conductive material. Any known resin may be used as the curable resin, and from the viewpoints of strength, electrical properties, image quality endurance and the like, examples thereof include phenol resins, urethane resins, melamine resins, diallyl phthalate resins, and siloxane resins.

Charge transporting materials or charge transporting resins which can be used for the charge transporting layer 32 are employable as the charge transporting compound. Examples of the electrically conductive material include metallocene compounds such as dimethyl ferrocene and metal oxides such as antimony oxide, tin oxide, titanium oxide, indium oxide, indium tin oxide (ITO) or the like, while the scope of the electrically conductive material is not limited thereto.

The electric resistivity of the protective layer 5 is preferably within a range of about $10^9$ Ω·cm to about $10^{14}$ Ω·cm. When the electric resistance exceeds about $10^{14}$ Ω·cm, there will be a case where remained potential increases, and on the other hand, when the electric resistance is smaller than about $10^9$ Ω·cm, a charge leakage in an interfacial direction may become non-neglectable, and there may be a case where degradation of resolution occurs.

The thickness of the protective layer 5 is preferably within the range of from about 0.5 μm to about 20 μm, more preferably within the range of from about 2 μm to about 10 μm. In the case where the protective layer 5 is provided, a blocking layer may be provided between the photosensitive layer 3 and the protective layer 5 in order to prohibit a leakage of charge from the protective layer 5 to the photosensitive layer 3. Any publicly known blocking layer can be employed as is in the case of the protective layer 5.

The protective layer 5 may contain a fluorine-containing compound to improve surface lubricity thereof. Improvement in surface lubricity leads to a decrease in the frictional coefficient with respect to a cleaning member and improvement in abrasion resistance of the protective layer. It is also effective in preventing adhesion of discharge products, developer and paper powder onto the photoreceptor surface and elongating the life of the photoreceptor.

The fluorine-containing compound can be a fluorine-containing polymer such as polytetrafluoroethylene. The polymer may be contained as it is or in a form of particles.

The amount of the fluorine-containing compound contained is preferably about 20 weight % or less. A higher content may lead to problems in forming the cross-linked film.

While the protective layer 5 has sufficient oxidation resistance, the layer may contain an antioxidant to enhance the oxidation resistance. The antioxidant is preferably a hindered phenol or a hindered amine, but can also be a known antioxidant such as an organic sulfur-containing antioxidant, a phosphite antioxidant, a dithiocarbamic acid salt antioxidant, a thiourea antioxidant, or a benzimidazole antioxidant. The amount of the antioxidant added is preferably about 15 weight % or less and more preferably about 10 weight % or less.

Examples of the hindered phenol antioxidant include 2,6-di-t-butyl-4-methylphenol, 2,5-di-t-butylhydroquinone, N,N'-hexamethylene bis(3,5-di-t-butyl-4-hydroxy)hydrocinnamide, 3,5-di-t-butyl-4-hydroxy-benzylphosphonate-diethylester, 2,4-bis[(octylthio)methyl]-o-cresol, 2,6-di-t-butyl-4-ethylphenol, 2,2'-methylene bis(4-methyl-6-t-butylphenol), 2,2'-methylene bis(4-ethyl-6-t-butylphenol), 4,4'-butylidene bis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidene bis (3-methyl-6-t-butyl phenol).

The protective layer 5 may also contain other known additives used in film coating such as a leveling agent, an ultraviolet absorbent, a photostabilizer, or a surfactant.

In order to form the protective layer 5, a mixture of the various materials and additives described above is applied onto a photosensitive layer and the coated layer is heated. The heating causes a three-dimensionally cross-linking curing reaction, forming a stiff cured film. While the heating temperature is not particularly limited as long as it does not affect the photosensitive layer, which is provided under the protective layer 5, the temperature is preferably in the range from room temperature to about 200° C., and more preferably in the range of about 100 to about 160° C.

If the protective layer 5 is formed by using a cross-linkable material, a cross-linking reaction may be carried out in the presence of a catalyst, while the cross-linking reaction may be carried out in the absence of a catalyst. Examples of the catalyst include acids such as hydrochloric acid, sulfuric acid, phosphoric acid, formic acid, acetic acid, or trifluoroacetic acid; bases such as ammonia or triethylamine; organic tin compounds such as dibutyltin diacetate, dibutyltin dioctoate, or stannous octoate; organic titanium compounds such as tetra-n-butyl titanate, or tetraisopropyl titanate; iron salts, manganese salts, cobalt salts, zinc salts, and zirconium salts of organic carboxylic acids; and aluminum chelate compounds.

A coating solution for a protective layer 5 may contain a solvent 5 to facilitate coating, if necessary. Specific examples of the solvent include water, and ordinary organic solvents such as methanol, ethanol, n-propanol, iso-propanol, n-butanol, benzyl alcohol, methylcellosolve, ethylcellosolve, acetone, methyl ethyl ketone, cyclohexanone, methyl acetate, n-butyl acetate, dioxane, tetrahydrofuran, methylene chloride, chloroform, dimethyl ether, and dibutyl ether. One of these solvents may be used alone, or two or more of them can be used together.

In forming the protective layer 5, any of ordinary methods such as blade coating, wire bar coating, spray coating, dip coating, bead coating, air knife coating, or curtain coating methods may be used.

While a layer thickness of a functional layer for obtaining high resolution provided upper than the charge generating layer of the photoreceptor 12 in the exemplary embodiment of the invention may be sealed to any value as long as the desired characteristic is obtainable, it is preferably about 50 μm or less. In the case where the functional layer is a thin film, a combination of the subbing layer 2 containing the combination of the metal oxide particles and the acceptor compound and the protective layer 5 with high strength can be particularly effectively used.

The photoreceptor 12 is not limited to the above-described configuration. For example, the photoreceptor 12 may have a configuration without an intermediate layer 4 and/or a protective layer 5. Thus, the photoreceptor may have a configuration in which the subbing layer 2 and the photosensitive layer 3 are formed on the electrically conductive substrate 7; a configuration in which the subbing layer 2, the intermediate layer 4, and the photosensitive layer 3 are formed in that order on the electrically conductive substrate 7; or a configuration in which the subbing layer 2, the photosensitive layer 3, and the protective layer 5 are formed in that order on the electrically conductive substrate 7.

The charge generating layer 31 can be disposed under or over the charge transporting layer 32. Further, the photosensitive layer 3 may have a single layer structure. In such a case, the photoreceptor may have the protective layer 5 on the photosensitive layer 3, or may have both the subbing layer 2 and the protective layer 5. In addition, the intermediate layer 4 may be formed over the subbing layer 2 as described above.

While the subbing layer 2 of the photoreceptor 12 preferably contains filler was described above, the charge generating layer 31 of the photoreceptor 12 and a layer disposed at the surface side (opposite side to the electrically conductive substrate 7) preferably contain no filler.

The reason thereof is assumed to be that when the filler is contained in the photosensitive layer 3, an irregular reflection to the light having the first wavelength may occur in the region near to the surface of the photoreceptor 12 so as to decrease quantity of the reflected light generated by the irradiation of light having the first wavelength, and accordingly, the accuracy of measurement of the toner density may decreased.

The quantity of the reflected light generated by the irradiation of light having the first wavelength to the photoreceptor 12 may be controlled by controlling the film thickness of the photosensitive layer 3. However, the film thickness of the photosensitive layer 3 is employed in order to achieve the desired photoreceptor characteristic since the film thickness of the photosensitive layer 3 may directly act on the sensitivity and the maintenance property of the photoreceptor 12. Accordingly, it is difficult to employ the film thickness control of the photosensitive layer 3 for controlling quantity of reflected light generated by the irradiation of light having the first wavelength irradiated to the photoreceptor 12.

On the other hand, in the case where the filler is contained in the subbing layer 2, quantity of the reflected light generated by the irradiation of light having the first wavelength reflected from the substrate and the subbing layer is easily adjustable and accordingly, it is preferable because it becomes easy to adjust reflectance to the first reflected light by the whole photoreceptor 12.

The photoreceptor 12 preferably has the configuration having at least: the electrically conductive substrate 7 whose regular reflectance of the surface of itself to the light irradiated from the light emitting element 22A of the density measuring device 22 and with the first wavelength is arranged within the range of from 30% to 95%; the subbing layer 2 which has the optical transmittance of about 50% or greater per unit thickness of the layer with respect to the light having the first wavelength irradiated from the light emitting element 22A and is provided on or above the electrically conductive substrate 7; and the photosensitive layer 3 which has no absorption with respect to light having the first wavelength but has absorption with respect to light having the second wavelength which is irradiated from the exposing device 18 and is different from the first wavelength and is provided on or above the subbing layer 2. In the case where the photoreceptor 12 has a configuration further having any other layers such as the protective layer 5, the intermediate layer 4 or the like in addition to the electrically conductive substrate 7, the subbing layer 2 and photosensitive layer 3, it is preferable that a layer(s) disposed at the side nearer to the surface than the photosensitive layer 3 does not have absorption with respect to light having the first wavelength.

Next, the developer which can be employed in one exemplary embodiment of the invention will be described. The image forming apparatus of the present invention may employ either one-composition system developer composed of toner only or two-composition system developer composed of toner and carrier.

While the shape of the toner used is not particularly limited, it is preferably a sphere shape from the viewpoints of image quality and ecology. The spherical toner is one having an average shape factor (SF1) in the range of about 100 to about 150, and preferably about 100 to about 140 to attain high transfer efficiency. Toners having an average shape factor SF1 of more than about 140 may have decreased transfer efficiency, leading to visually observable deterioration in image quality of print samples.

A spherical toner contains at least a binder resin and a coloring agent. The spherical toner is preferably particles having a diameter of about 2 μm to about 12 μm and more preferably those having a diameter of about 3 μm to about 9 μm.

Examples of the binder resin include homopolymers and copolymers of styrenes, monoolefins, vinylesters, a-methylene aliphatic monocarboxylic acid esters, vinylethers, and vinylketones. Specific examples of the binder resin include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, and polypropylene. Examples of the binder resin further include polyester, polyurethane, epoxy resin, silicone resin, polyamide, modified rosin and paraffin wax.

Specific examples of the coloring agent include magnetic powders such as magnetite or ferrite, carbon black, aniline blue, Calco oil blue, chromium yellow, ultramarine blue, Du Pont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

Known additives such as a charge control agent, a releasing agent, or other inorganic fine particles may be added internally or externally to the spherical toner.

Specific examples of the releasing agent include low-molecular weight polyethylene, low-molecular weight polypropylene, Fischer-Tropsch wax, montan wax, carnauba wax, rice wax and candelilla wax.

While any known charge control agent may be used, it is preferably an azo metal complex compound, a metal complex compound of salicylic acid, or a resin-type charge control agent containing a polar group.

Other inorganic fine particles can be used for control of powder flowability and charge, and preferably small-diameter inorganic fine particles having an average primary particle diameter of about 40 nm or less. They can be used together with large-diameter inorganic or organic fine particles for reduction of adhesion. These other inorganic fine particles can be chosen from known inorganic fine particles.

Surface treatment of the small-diameter inorganic fine particles can be effective in increasing dispersion property thereof and powder flowability.

The method of producing the spherical toner is not particularly limited and any known method may be employed as such. Specifically, the toner may be produced, for example, in accordance with a kneading-pulverizing method, a method for changing the shape of particles obtained in accordance with the kneading-pulverizing method by applying mechanical impulsive force or thermal energy thereto, an emulsion-polymerization flocculation method, or a dissolution suspension method. Alternatively, a toner having a core-shell structure may be produced by using the spherical toner obtained by the method described above as a core, attaching aggregated particles to the core and thermally heating the resultant. When an external additive is added to toner mother particles, a toner can be produced by mixing a spherical toner and the external additive with a Henschel Mixer or a V blender. When a spherical toner is produced in a wet manner, the external additive may be added to the toner mother particles in a wet system.

The image forming apparatus 10 is further composed of a system control device 38 for controlling the whole image forming apparatus 10 and a data acquisition device 42 for acquiring image data of pictorial images to be recorded in the image forming apparatus 10.

The system control device 38 is connected to a power source 14A of the charging device 14, the exposing device 18, the developing bias voltage applying component 20A of the developing device 20, light emitting element 22A of the density measuring device 22, arithmetically calculating component 22 C of the density measuring device 22, a transfer bias voltage applying component 24A and the data acquisition device 42 in a manner capable of transmitting and receiving data or signal, and at the same time, connected to various machineries and equipments, not shown, arranged to the image forming apparatus 10 in a manner capable of transmitting and receiving signal.

The data acquisition device 42 receives data from outside equipments (personal computer, etc.) of the image forming apparatus 10 via a wireless communication network or a cable transmission network.

The system control device 38 is composed as a microcomputer, not shown, containing CPU, ROM and RAM; controls each devices contained in the image forming apparatus 10, together with controlling image forming condition based on the measured results of the toner densities that were measured by means of the density measuring device 22.

Additionally the system control device 38 corresponds to a control means for the image forming apparatus of the present invention.

The system control device 38 controls each devices contained in the image forming apparatus 10, and at the same time, controls image forming condition based on the measured results of the toner densities that were measured by means of the density measuring device 22.

In such the image forming apparatus lo being controlled about the power source 14A by means of the system control device 38, the surface of the photoreceptor 12 is charged up to a predetermined charging potential. Further, controlled by the system control device 38, the exposing device 18 irradiates the exposing light (the light having the second wavelength) that was modulated being based on an object image data to be formed at the image forming apparatus 10 onto the photoreceptor 12. As a result, an electrostatic latent image corresponding to the image data will be formed on the photoreceptor 12.

When the region where the electrostatic latent image is formed on the photoreceptor 12 arrives, advanced by revolution of the photoreceptor 12, to a region where the developing device 20 is disposed, the electrostatic latent image will be developed by toner, and a toner image corresponding to the electrostatic latent image will be formed on the photoreceptor 12. Regarding with the development by means of the developing device 20, it is carried out being caused by applying the developing bias voltage that responding to control of the system control device 38 from the developing bias voltage applying component 20A to the developing roll 20B.

Furthermore, when the region where the electrostatic latent image is formed arrives, advanced by revolution of the photoreceptor 12, to a region where the density measuring device 22 is installed, the density of the toner image will be measured by means of the density measuring device 22.

In the system control device 38, whether the toner density measured by means of the density measuring device 22 coincides with the density of the image data of the electrostatic latent image formed by means of the exposing device 18 or not will be distinguished and in the case where the densities are inconsistent, the image formation condition should be controlled.

The image formation condition means at least one of a charging potential of the charging device 14, an exposure amount by the exposing device 18, a developing bias voltage of the developing device 20, and a transfer bias voltage of the transfer device 24. Namely, in the system control device 38, at least one of the charging device 14, the exposing device 18, the developing device 20, and the transfer device 24 in order that at least one of the charging potential of the charging device 14, the exposure amount by the exposing device 18, the developing bias voltage of developing device 20, and the transfer bias voltage of the transfer device 24 will be adjusted as the image formation condition.

Figure 4:
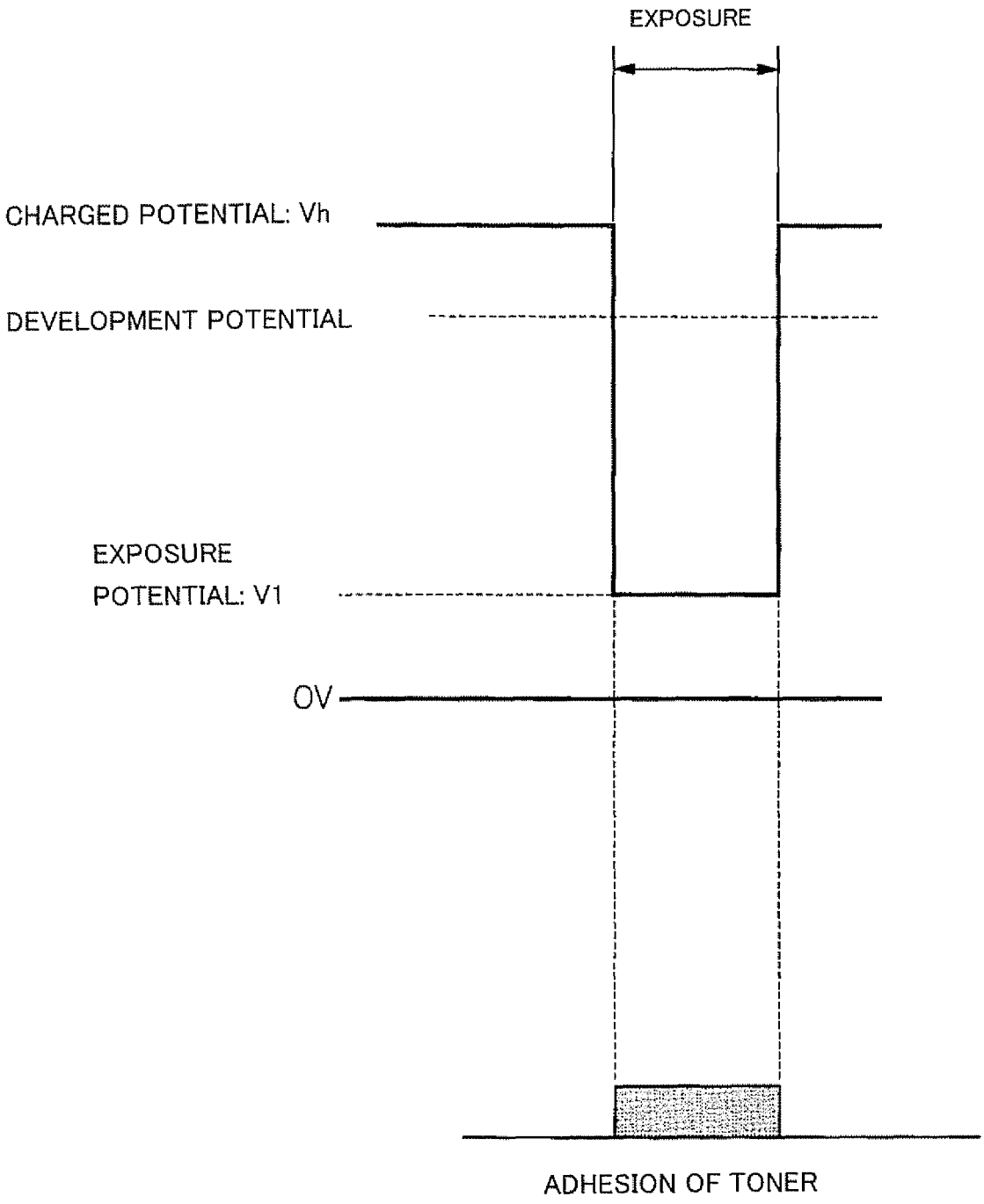
FIG. 4 is a schematic view showing charge potential, exposure potential and development potential in the photoreceptor.

As shown in FIG. 4, with respect to the amount of the toner carried by the photoreceptor 12 in the electrophotographic image forming apparatus 10, the photoreceptor 12 is charged by the charging device 14 to a charge potential of Vh and when exposed by the exposing device 18, the exposed region that has been exposed has an exposure potential of V1. Then, in accordance with the difference in potential between the exposure potential V1 in the exposed region and a developing bias voltage Vdeve of the developing device 20, the larger the difference in potential is, the larger the amount of toner that is carried on the surface of the photoreceptor 12. In other words, the larger the difference between the exposure potential V1 and the developing bias voltage Vdeve becomes, the more the amount of toner carried on the photoreceptor 12 increases and the higher the density of a formed pictorial image becomes.

Accordingly, when the density of the toner image detected by the density measuring device 22 is higher than the density of the image data for the pictorial image to be formed, in the control process for effecting control so that the density of the toner image detected by the density measuring device 22 equals the density of the image data of the pictorial image which is carried out in the system control device 38, it is appropriate, for example, to adjust the exposure amount by the exposing device 18 so that the difference between the exposure potential V1 and the developing bias voltage Vdeve becomes smaller than the difference between the exposure potential V1 and the developing bias voltage Vdeve at the time when the higher density toner image was formed (which may be referred to as a reference potential difference).

In this occasion, although a density fluctuation in the image forming apparatus 10 and a deterioration of the picture quality are suppressible, as described above, by adjusting the image formation condition based on the density of the toner image measured by means of the density measuring device 22, when the accuracy of the measurement result at the density measuring device 22 degrades, anxieties will occur that the picture quality of the resultant image relationally deteriorates.

However in the image forming apparatus 10 of one exemplary embodiment of the invention, as described above, the photoreceptor 12 is composed by laminating the subbing layer 2 whose optical transmittance is 50% or greater per unit thickness of the layer with respect to the light having the first wavelength irradiated from the light emitting element 22A, and the photosensitive layer 3 not having absorption with respect to light having the first wavelength but having absorption with respect to light having the second wavelength irradiated from the exposing device 18, different from the first wavelength, on the electrically conductive substrate 7 whose regular reflectance of the surface of itself to the light irradiated from the light emitting element 22A of the density measuring device 22 and with the first wavelength is arranged in a range of 30% to 95%.

Accordingly, because the density of the toner image formed on the photoreceptor 12 can be measured accurately by means of the density measuring device 22, and at the same time, because an image with little density fluctuation can be formed in the image forming apparatus 10, the picture quality deterioration in the image forming apparatus 10 is suppressible.

While an exemplary embodiment of a monochromic image-forming apparatus is shown in FIG. 1, the image forming apparatus is not limited thereto, and examples thereof further include an apparatus having plural image forming units such as a tandem color image-forming apparatus, and a rotary developing apparatus (which is also called a rotary developing machine). The rotary developing apparatus has plural developing units that rotate and move, and makes at least one developing unit use of which is needed in a printing face the photoreceptor to form at least one toner image having a desirable color on the photoreceptor one by one.

Alternatively, a process cartridge, which is attachable to and detachable from the image forming apparatus and in which a photoreceptor and at least one device selected from a charging device, a developing device, a transfer device and a cleaning device are integrated may be used in one embodiment of the invention.

EXAMPLES

Hereinafter, the invention will be described in more detail with reference to examples and comparative examples, while it should be understood that the invention is not restricted by these examples.

Example 1

An aluminum substrate having a cylindrical shape with a diameter of 84 mm, a length of 357 mm and a thickness of 1 mm is prepared to form an electrically conductive substrate. A surface treatment is carried out over the surface of the aluminum substrate employing precise cutting treatment with the use of an abrasive wheel and then, the light with the wavelength of 950 nm as the first wavelength is irradiated in an intensity that the reflectance from the substrate having mirror face becomes 100%, measuring the regular reflectance of the surface of the electrically conductive substrate by using INSTANT MULTI PHOTOMETRY SYSTEM MCPD-2000 (trade name, manufactured by Otsuka Electron Co., Ltd.) to turn out to be 55%

1.25 parts by weight of a silane coupling agent (KBM603 manufactured by Shin-Etsu Chemical) is added to an agitated mixture of 100 parts by weight of zinc oxide manufactured by Tayca Corporation and having an average primary particle diameter of 70 nm and a specific surface area of 15 $m^2/g$ and 500 parts by weight of tetrahydrofuran. The resultant mixture is agitated for two hours. Then, tetrahydrofuran is distilled off under a reduced pressure, the residue is baked at 120° C. for three hours to obtain a zinc oxide pigment surface-treated with the silane coupling agent.

60 parts by weight of the surface-treated zinc oxide pigment, 0.6 part by weight of alizarin and 13.5 parts by weight of a hardening agent (a blocked isocyanate SUMIDUR 3175;

trade name, manufactured by Sumitomo Bayer Urethane Co.)), 38 parts by weight of a solution formed by dissolving 15 parts by weight of butyral resin (S-LEC BM-1 manufactured by Sekisui Chemical Co.) in 85 parts by weight of methyl ethyl ketone, and 25 parts by weight of methyl ethyl ketone are mixed, and the resultant mixture is subjected to dispersing with a sand mill containing glass beads with a diameter of 1 mm for two hours to obtain a liquid dispersion. 0.005 part by weight of dioctyltin dilalurate serving as a catalyst and 4.0 parts by weight of silicone resin particles (trade name: TOSPEARL 145, manufactured by GE Toshiba Silicones) are added to the liquid dispersion so as to obtain a coating solution for a subbing layer. The coating solution is applied to the aluminum substrate with a dip coating method and the resultant coating is dried and hardened at 170° C. for 40 minutes to form a subbing layer having a thickness of 15 μm.

In addition, the coating solution for the subbing layer is applied over a glass plate (trade name: S-1111, available from Matsunami Class Ind., Ltd.; transmittance with respect to light with a wavelength of 950 nm, that is used as the first wavelength, is 100%) in accordance with dipping application process to form a sample for measuring transmittance. The transmittance of the sample for measuring the transmittance with respect to the light with a wavelength of 950 nm, which is used as the first wavelength, is measured by using a spectrophotometer U-2000 (trade name; manufactured by Hitachi, Ltd.) reading 3.7%. Since the thickness of the subbing layer is 15 μm, the transmittance of the subbing layer per unit thickness of the layer with respect to the light having the first wavelength (950 nm) is 55%.

As described above, in the subbing layer of the photoreceptor in Example 1, X=55 (%), Y=15 (μm). Therefore, the subbing layer satisfies the relationship of Inequality (1) (Y>X/4.5) because X/4.5=55/4.5=12.2, that is smaller than 15.

Then, a photosensitive layer is formed on the subbing layer. First, a mixture of 15 parts by weight of a charge generating material, hydroxygallium phthalocyanine having diffraction peaks at least at Bragg angles (2θ±0.2°) of 7.3°, 16.0°, 24.9°, and 28.0° as determined by an X-ray diffraction spectrum obtained by using a Cukα ray, 10 part by weight of a binder resin, a vinyl chloride-vinyl acetate copolymer resin (VMCH manufactured by Nippon Unicar Co., Ltd.), and 200 parts by weight of n-butyl acetate is stirred with a sand mill containing glass beads with a diameter of 1 mm for four hours. 175 parts by weight of n-butyl acetate and 180 parts by weight of methyl ethyl ketone are added to the resultant dispersion, and the resultant mixture is agitated to obtain a coating solution for a charge generating layer. The coating solution for a charge generating layer is applied to the subbing layer in accordance with dip coating, and the resultant coating is dried at room temperature to form a charge generating layer having a thickness of 0.2 μm.

Then, 4 parts by weight of a charge transport material, N,N'-diphenyl-N,N'-bis(3-methylphenyl)-[1,1']-biphenyl-4,4'-diamine, and 6 parts by weight of a bisphenol Z-type polycarbonate resin (viscosity-average molecular weight: 40,000) are mixed with and dissolved in 23 parts by weight of tetrahydrofuran and 10 parts by weight of toluene. 0.2 part by weight of 2,6-di-t-butyl-4-methylphenol is added to the resultant mixture so as to obtain a coating solution for a charge transporting layer. The coating solution is applied to the charge generating layer, and the resultant coating is dried at 135° C. for 40 minutes to form a charge transporting layer having a thickness of 28 μm. Thus, a photoreceptor is obtained.

A sample formed by applying the photosensitive layer on a glass plate is separately prepared for measuring absorption. An absorbance of the sample is measured by using a spectrophotometer U-2000 (trade Name; manufactured by Hitachi, Ltd.) in the same manner as about the subbing layer, reading absorbance of 0.05 with respect to the light with the wavelength of 950 nm, that is used as the first wavelength, and absorbance of 1.0 with respect to the light with the wavelength of 780 nm, that is used as the second wave length (exposure light). Namely, the photosensitive layer of the photoreceptor in Example 1 does not have absorption with respect to light having the first wavelength but has absorption with respect to light having the second wavelength.

Further, the resultant photoreceptor is irradiated with the light having the wavelength of 950 nm, that is used as the first wavelength, from the charge transporting layer side to the electrically conductive substrate side, and regular reflectance of the photoreceptor with respect to the light having the first wavelength is measured in the same manner as that for the subbing layer to read 4%.

The resultant photoreceptor is subjected to a printing test is conducted using a laser printer DOCUCENTRE f1100 (trade name, manufactured by Fuji Xerox Co., Ltd.) and normal paper (trade name: A3P paper, available from Fuji Xerox Co., Ltd.) and by means of a density sensing equipment settled with light having the first wavelength of 950 nm to be irradiated to the photoreceptor.

The print test is conducted by measuring reproduction factors to input pixel densities by forming each one image of A: 100% pixel density; B: 70% pixel density; C: 50% pixel density and D: 20% pixel density respectively under an atmosphere of 20° C. and 40% RH, and the image density is measured about each pixel density by using a reflection spectro densitometer (manufactured by X-Rite, Incorporated) to turn out each reproduction factor of A: 97%; B: 95%; C: 95% and D: 89%.

Example 2

A photoreceptor of Example 2 is prepared in the same manner as that of Example 1, except that the dispersing with the sand mill is performed for 5 hours and the subbing layer is formed to have a thickness of 20 μm. A sample for measuring transmittance of Example 2 is also prepared in the same manner as that of Example 1 except for these modifications and subjected to measurement of transmittance in the same manner as that of Example 1. The transmittance of the sample of Example 2 with respect to the light with a wavelength of 950 nm, which is used as the first wavelength, is read to be 3.75%. Since the thickness of the subbing layer is 20 μm, the transmittance of the subbing layer of the photoreceptor of Example 2 per unit thickness of the layer with respect to the light having the first wavelength (950 nm) is 75%.

As described above, in the subbing layer of the photoreceptor of Example 2, X=75 (%), Y=20 (μm). Therefore, the subbing layer of the photoreceptor in Example 2 satisfies the relationship of Inequality (1) (Y>X/4.5) because X/4.5=75/4.5=16.7, that is smaller than 20.

Further, the resultant photoreceptor of Example 2 is irradiated with the light having the wavelength of 950 nm, that is used as the first wavelength, from the charge transporting layer side to the electrically conductive substrate side, and regular reflectance of the photoreceptor with respect to the light having the first wavelength is measured in the same manner as that Example 1 to read 5%.

A print test for the photoreceptor of Example 2 is conducted in the same manner as that in Example 1 to turn out each reproduction factor of A: 99%; B: 98%; C: 93% and D: 89%.

Example 3

A photoreceptor of Example 3 is prepared in the same manner as that of Example 1, except that the dispersing with the sand mill is performed for 10 hours and the subbing layer is formed to have a thickness of 25 μm. A sample for measuring transmittance of Example 3 is also prepared in the same manner as that of Example 1 except for these modifications and subjected to measurement of transmittance in the same manner as that of Example 1. The transmittance of the sample of Example 3 with respect to the light with a wavelength of 950 nm, which is used as the first wavelength, is read to be 3.6%. Since the thickness of the subbing layer is 25 μm, the transmittance of the subbing layer of the photoreceptor of Example 3 per unit thickness of the layer with respect to the light having the first wavelength (950 nm) is 90%.

As described above, in the subbing layer of the photoreceptor of Example 3, X=90 (%), Y=25 (μm). Therefore, the subbing layer of the photoreceptor in Example 3 satisfies the relationship of Inequality (1) (Y>X/4.5) because X/4.5=90/4.5=20, that is smaller than 25.

Further, the resultant photoreceptor of Example 3 is irradiated with the light having the wavelength of 950 nm, that is used as the first wavelength, from the charge transporting layer side to the electrically conductive substrate side, and regular reflectance of the photoreceptor with respect to the light having the first wavelength is measured in the same manner as that Example 1 to read 6%.

A print test for the photoreceptor of Example 3 is conducted in the same manner as that in Example 1 to turn out each reproduction factor of A: 99%; B: 98%; C: 94% and D: 88%.

Example 4

A photoreceptor of Example 4 is prepared in the same manner as that of Example 1, except that the dispersing with the sand mill is performed for 5 hours and the subbing layer is formed to have a thickness of 12 μm. A sample for measuring transmittance of Example 4 is also prepared in the same manner as that of Example 1 except for these modifications and subjected to measurement of transmittance in the same manner as that of Example 1. The transmittance of the sample of Example 4 with respect to the light with a wavelength of 950 nm, which is used as the first wavelength, is read to be 6.3%. Since the thickness of the subbing layer is 12 μm, the transmittance of the subbing layer of the photoreceptor of Example 4 per unit thickness of the layer with respect to the light having the first wavelength (950 nm) is 75%.

As described above, in the subbing layer of the photoreceptor of Example 4, X=75 (%), Y=12 (μm). Therefore, the subbing layer of the photoreceptor in Example 4 does not satisfy the relationship of Inequality (1) (Y>X/4.5) because X/4.5=75/4.5=16.7, that is larger than 12.

Further, the resultant photoreceptor of Example 4 is irradiated with the light having the wavelength of 950 nm, that is used as the first wavelength, from the charge transporting layer side to the electrically conductive substrate side, and regular reflectance of the photoreceptor with respect to the light having the first wavelength is measured in the same manner as that Example 1 to read 9%.

A print test for the photoreceptor of Example 4 is conducted in the same manner as that in Example 1 to turn out each reproduction factor of A: 75%; B: 70%; C: 65% and D: 50%.

Example 5

An aluminum substrate having a cylindrical shape with a diameter of 84 mm, a length of 357 mm and a thickness of 1 mm is prepared to form an electrically conductive substrate. A surface treatment is carried out over the surface of the aluminum substrate employing precise cutting treatment with the use of an abrasive wheel and then, the light with the wavelength of 950 nm as the first wavelength is irradiated and the regular reflectance of the surface of the electrically conductive substrate is measured in the same manner as Example 1, to turn out to be 30%. A photoreceptor is prepared by providing, on the substrate, a subbing layer and a photosensitive layer in the same manner as Example 1.

The resultant photoreceptor of Example 5 is irradiated with the light having the wavelength of 950 nm, that is used as the first wavelength, from the charge transporting layer side to the electrically conductive substrate side, and regular reflectance of the photoreceptor with respect to the light having the first wavelength is measured in the same manner as that Example 1 to read 1.5%.

A print test for the photoreceptor of Example 5 is conducted in the same manner as that in Example 1 to turn out each reproduction factor of A: 70%; B: 70%; C: 55% and D: 40%.

Example 6

An aluminum substrate having a cylindrical shape with a diameter of 84 mm, a length of 357 mm and a thickness of 1 mm is prepared to form an electrically conductive substrate. A surface treatment is carried out over the surface of the aluminum substrate employing precise cutting treatment with the use of an abrasive wheel and then, the light with the wavelength of 950 nm as the first wavelength is irradiated and the regular reflectance of the surface of the electrically conductive substrate is measured in the same manner as Example 1, to turn out to be 95%. A photoreceptor is prepared by providing, on the substrate, a subbing layer and a photosensitive layer in the same manner as Example 1.

The resultant photoreceptor of Example 6 is irradiated with the light having the wavelength of 950 nm, that is used as the first wavelength, from the charge transporting layer side to the electrically conductive substrate side, and regular reflectance of the photoreceptor with respect to the light having the first wavelength is measured in the same manner as that Example 1 to read 9.5%.

A print test for the photoreceptor of Example 5 is conducted in the same manner as that in Example 1 to turn out each reproduction factor of A: 60%; B: 60%; C: 50% and D: 35%.

Example 7

A photoreceptor of Example 7 is prepared in the same manner as that of Example 1, except that the dispersing with the sand mill is performed for 1.8 hours. A sample for measuring transmittance of Example 7 is also prepared in the same manner as that of Example 1 except for the modification and subjected to measurement of transmittance in the same manner as that of Example 1. The transmittance of the sample of Example 7 with respect to the light with a wavelength of 950 nm, which is used as the first wavelength, is read to be 3.33%. Since the thickness of the subbing layer is 15 μm, the transmittance of the subbing layer of the photoreceptor of Example 7 per unit thickness of the layer with respect to the light having the first wavelength (950 nm) is 50%.

As described above, in the subbing layer of the photoreceptor of Example 7, X=50 (%), Y=15 (μm). Therefore, the subbing layer of the photoreceptor in Example 7 satisfies the relationship of Inequality (1) (Y>X/4.5) because X/4.5=50/4.5=11.1, that is smaller than 15.

Further, the resultant photoreceptor of Example 7 is irradiated with the light having the wavelength of 950 nm, that is used as the first wavelength, from the charge transporting layer side to the electrically conductive substrate side, and regular reflectance of the photoreceptor with respect to the light having the first wavelength is measured in the same manner as that Example 1 to read 5%.

Comparative Example 1

A photoreceptor of Comparative example 1 is prepared in the same manner as that of Example 1, except that the dispersing with the sand mill is performed for 1 hour and the subbing layer is formed to have a thickness of 12 μm. A sample for measuring transmittance of Comparative example 1 is also prepared in the same manner as that of Example 1 except for these modifications and subjected to measurement of transmittance in the same manner as that of Example 1. The transmittance of the sample of Comparative example 1 with respect to the light with a wavelength of 950 nm, which is used as the first wavelength, is read to be 2.9%. Since the thickness of the subbing layer is 12 μm, the transmittance of the subbing layer of the photoreceptor of Comparative example 1 per unit thickness of the layer with respect to the light having the first wavelength (950 nm) is 35%.

As described above, in the subbing layer of the photoreceptor of Comparative example 1, X=35 (%), Y=12 (μm). Therefore, the subbing layer of the photoreceptor in Comparative example 1 satisfies the relationship of Inequality (1) (Y>X/4.5) because X/4.5=35/4.5=7.8, that is smaller than 12.

Further, the resultant photoreceptor of Comparative example 1 is irradiated with the light having the wavelength of 950 nm, that is used as the first wavelength, from the charge transporting layer side to the electrically conductive substrate side, and regular reflectance of the photoreceptor with respect to the light having the first wavelength is measured in the same manner as that Example 1 to read 13%.

A print test for the photoreceptor of Comparative example 1 is conducted in the same manner as that in Example 1 to turn out each reproduction factor of A: 55%; B: 40%; C: 40% and D: 30%. These reproduction factors of Comparative example 1 are significantly inferior to those of Examples 1 to 7.

Comparative Example 2

An aluminum substrate having a mirror surface and a cylindrical shape with a diameter of 84 mm, a length of 357 mm and a thickness of 1 mm is prepared as an electrically conductive substrate. The light with the wavelength of 950 nm as the first wavelength is irradiated and the regular reflectance of the surface of the electrically conductive substrate is measured in the same manner as Example 1, to turn out to be 100%. A photoreceptor is prepared by providing, on the substrate, a subbing layer and a photosensitive layer in the same manner as Example 1.

The resultant photoreceptor of Comparative example 2 is irradiated with the light having the wavelength of 950 nm, that is used as the first wavelength, from the charge transporting layer side to the electrically conductive substrate side, and regular reflectance of the photoreceptor with respect to the light having the first wavelength is measured in the same manner as that Example 1 to read 15%.

A print test for the photoreceptor of Comparative example 2 is conducted in the same manner as that in Example 1 to turn out each reproduction factor of A: 50%; B: 40%; C: 40% and D: 35%. These reproduction factors of Comparative example 2 are significantly inferior to those of Examples 1 to 7.

Comparative Example 3

A mirror face aluminum substrate having a mirror surface and a cylindrical shape with a diameter of 84 mm, a length of 357 mm and a thickness of 1 mm is prepared as an electrically conductive substrate. The electrically conductive substrate is subjected to a wet horning treatment to result a centerline average surface roughness (Ra) of 0.2 μm. The light with the wavelength of 950 nm as the first wavelength is irradiated and the regular reflectance of the surface of the electrically conductive substrate is measured in the same manner as Example 1, to turn out to be 20%. A photoreceptor is prepared by providing, on the substrate, a subbing layer and a photosensitive layer in the same manner as Example 1.

The resultant photoreceptor of Comparative example 3 is irradiated with the light having the wavelength of 950 nm, that is used as the first wavelength, from the charge transporting layer side to the electrically conductive substrate side, and regular reflectance of the photoreceptor with respect to the light having the first wavelength is measured in the same manner as that Example 1 to read 1%.

A print test for the photoreceptor of Comparative example 3 is conducted in the same manner as that in Example 1 to turn out each reproduction factor of A: 50%; B: 45%; C: 40% and D: 40%. These reproduction factors of Comparative example 3 are significantly inferior to those of Examples 1 to 7.

What is claimed is:

1. An image forming apparatus comprising:

an image holding member comprising:

a substrate having a surface having regular reflectance in a range of about 30% to about 95% with respect to light having a first wavelength; and a subbing layer having a light transmittance of about 50% or greater per unit thickness of the layer with respect to light having the first wavelength and a photosensitive layer having absorption with respect to light having a second wavelength that is different from the first wavelength, the subbing layer and the photosensitive layer being layered on the substrate in this order;

a charging unit which charges the image holding member;

a latent image-forming unit which forms an electrostatic latent image on the image holding member by exposing the image holding member charged by the charging unit with light having the second wavelength;

a development unit which develops the electrostatic latent image using a toner and forms a toner image corresponding to the electrostatic latent image on the image holding member;

a measuring unit which comprises:

an irradiation unit which irradiates light having the first wavelength onto the image holding member; and a detection unit which detects reflected light generated by the irradiation of light from the irradiation unit, and measures the density of the toner image formed on the image holding member based on the reflected light detected by the detection unit; and a control unit which controls the latent image-forming unit so that the latent image-forming unit forms the electrostatic latent image corresponding to a pictorial image having a predetermined density and, based on a measurement result of the density of the toner image obtained by the measuring unit, controls at least one selected from: a charge potential at which the image holding member is charged by the charging unit; an exposure amount at which the image holding member is exposed by the latent image-forming unit; and a development potential at which the toner is developed by the development unit, so that the measurement result obtained by the measurement unit becomes substantially equal to the predetermined density.

2. The image forming apparatus according to claim 1, wherein the regular reflectance of the surface of the substrate with respect to light having the first wavelength is in a range of about 35% to about 90%.

3. The image forming apparatus according to claim 1, wherein the regular reflectance of the surface of the substrate with respect to light having the first wavelength is in a range of about 40% to about 85%.

4. The image forming apparatus according to claim 1, wherein the light transmittance of the subbing layer per unit thickness of the layer with respect to light having the first wavelength is in a range of about 50% to about 95%.

5. The image forming apparatus according to claim 1, wherein the light transmittance of the subbing layer per unit thickness of the layer with respect to light having the first wavelength is in a range of about 60% to about 95%.

6. The image forming apparatus according to claim 1, wherein the light transmittance of the subbing layer per unit thickness of the layer with respect to light having the first wavelength is in a range of about 70% to about 95%.

7. The image forming apparatus according to claim 1, wherein regular reflectance of the image holding member as a whole with respect to light having the first wavelength is about 30% or less.

8. The image forming apparatus according to claim 1, wherein regular reflectance of the image holding member as a whole with respect to light having the first wavelength is about 25% or less.

9. The image forming apparatus according to claim 1, wherein regular reflectance of the image holding member as a whole with respect to light having the first wavelength is about 20% or less.

10. The image forming apparatus according to claim 1, wherein the subbing layer satisfies a relationship expressed by the following Inequality (1):

$$Y > X/4.5 \qquad \text{Inequality (1)}$$

wherein X represents the light transmittance (%) per unit thickness of the subbing layer with respect to light having the first wavelength, and Y represents the thickness (μm) of the subbing layer.

11. The image forming apparatus according to claim 1, wherein the subbing layer further comprises a filler.

12. The image forming apparatus according to claim 11, wherein the filler is a metal oxide particle.

13. The image forming apparatus according to claim 12, wherein the metal oxide particle comprises at least one selected from the group consisting of zinc oxide, titanium oxide, and tin oxide.

14. The image forming apparatus according to claim 1, wherein the absorbance of the photosensitive layer when the photosensitive layer is irradiated with light having the first wavelength is less than about 1/10 of the absorbance at the maximum absorbing wavelength of the photosensitive layer.

15. The image forming apparatus according to claim 1, wherein the regular reflectance of the surface of the substrate is a regular reflectance (%) obtained by measuring both a total reflectance and a diffusion reflectance of the substrate with respect to light having the first wavelength and calculating a difference therebetween by subtracting the diffusion reflectance from the total reflectance.

16. The image forming apparatus according to claim 1, wherein the subbing layer further comprises a filler in an amount in a range of about 5% by volume to about 70% by volume relative to a total volume of the subbing layer.

17. The image forming apparatus according to claim 16, wherein the amount of the filler is in a range of about 5% by volume to about 60% by volume relative to the total volume of the subbing layer.

* * * * *